US009945131B2

(12) United States Patent
Gosling et al.

(10) Patent No.: US 9,945,131 B2
(45) Date of Patent: Apr. 17, 2018

(54) SLIDABLE SNAP-IN TRIM SYSTEM

(71) Applicant: DIRTT Environmental Solutions, Ltd., Calgary (CA)

(72) Inventors: Geoff W. Gosling, Calgary (CA); Thomas A. Brown, Calgary (CA)

(73) Assignee: DIRTT Environmental Solutions, LTD, Calgary (CA)

( * ) Notice: Subject to any disclaimer, the term of this patent is extended or adjusted under 35 U.S.C. 154(b) by 0 days.

(21) Appl. No.: 15/177,077

(22) Filed: Jun. 8, 2016

(65) Prior Publication Data

US 2017/0226753 A1 Aug. 10, 2017

Related U.S. Application Data

(60) Provisional application No. 62/293,576, filed on Feb. 10, 2016.

(51) Int. Cl.
*E04F 19/04* (2006.01)
*E04F 19/00* (2006.01)

(52) U.S. Cl.
CPC ..... *E04F 19/0463* (2013.01); *E04F 19/0436* (2013.01)

(58) Field of Classification Search
CPC ..... E04F 19/0463; E04F 19/0436
See application file for complete search history.

(56) References Cited

U.S. PATENT DOCUMENTS 3,777,434 A * 12/1973 Selden ..... F16B 7/0493 52/28
4,103,465 A * 8/1978 McDonald, Jr. ..... E04H 1/1272 52/127.12
4,104,838 A * 8/1978 Hage ..... E04B 2/7433 160/135
4,178,658 A * 12/1979 Gergonne ..... E05F 5/06 16/86 A
4,512,118 A * 4/1985 Rasmussen ..... E06B 1/34 52/241

(Continued)

FOREIGN PATENT DOCUMENTS

CA 2057153 A1 * 2/1993 ..... E04F 19/0463
CH 379743 A * 7/1964 ..... E04F 19/0463

(Continued)

*Primary Examiner* — Jeanette E Chapman
(74) *Attorney, Agent, or Firm* — Workman Nydegger

(57) ABSTRACT

Snap-in trim systems include a mounting element securable to or integrated with a structural component of a building. Structural components include modular wall components suitable for having decorative or structural trim attached thereto. The mounting element extends longitudinally along a length of the structural component. A longitudinal connection element is secured to the mounting element along the length thereof. The connection element attaches to the mounting element at an attachment interface either anterior-perpendicularly, lateral-parallelly, or anterior-lateral-diagonally. A trim element is connected to or integrated with the connection element. Connected trim elements include an alignment element for ensuring proper positioning of the trim element relative to the connection element. Trim elements include baseboard, crown molding, window casing, door casing and door stops.

36 Claims, 28 Drawing Sheets

(56) References Cited

U.S. PATENT DOCUMENTS

| | | | | | |
|---|---|---|---|---|---|
| 4,545,168 | A * | 10/1985 | Dalton, Jr. | E04B 1/6108 | 52/239 |
| 4,571,907 | A * | 2/1986 | DeFouw | A47B 83/001 | 52/239 |
| 4,947,601 | A * | 8/1990 | McGuire | E04B 2/7425 | 52/239 |
| 5,065,558 | A * | 11/1991 | Boatsman | E04L 31/14 | 52/239 |
| 5,069,263 | A * | 12/1991 | Edwards | A47G 5/00 | 160/135 |
| 5,642,593 | A * | 7/1997 | Shieh | E04B 2/7424 | 160/130 |
| 6,341,457 | B1 * | 1/2002 | Aerts | E04B 2/7425 | 52/239 |
| 6,378,253 | B1 * | 4/2002 | Richardson | E04B 1/0046 | 52/204.5 |
| 7,340,866 | B1 * | 3/2008 | Smith | E06B 1/003 | 52/204.54 |
| 2007/0175123 | A1 * | 8/2007 | Bernier | E06B 3/9641 | 52/211 |
| 2011/0179733 | A1 * | 7/2011 | Picken | E04F 19/02 | 52/242 |

FOREIGN PATENT DOCUMENTS

| | | | | |
|---|---|---|---|---|
| DE | 1683258 | A1 * | 4/1970 | E04F 19/0495 |
| WO | WO-9306319 | A1 * | 4/1993 | E04F 19/045 |

* cited by examiner

SLIDABLE SNAP-IN TRIM SYSTEM

CROSS-REFERENCE TO RELATED APPLICATIONS

The present application claims the benefit of priority to U.S. Provisional Patent Application No. 62/293,576, filed on Feb. 10, 2016, entitled "Slidable Snap-in Trim System," the entire content of which is incorporated herein by reference.

BACKGROUND

1. Technical Field

This disclosure generally relates to modular wall systems. More specifically, the present disclosure relates to modular wall systems including decorative and/or structural trim and to systems, methods, and apparatus for securing or applying trim to interior and exterior portions of a building or other structure.

2. Related Technology

A typical building construction involves preparing and constructing walls as well as other building components at a build site. Additionally or alternatively, a builder may choose to use prefabricated wall modules to construct interior and/or exterior walls of the building. Once the walls are constructed, a typical building may incorporate additional features on the walls. For example, ordinarily, a building includes at least one door and one or more windows.

Furthermore, the builder may choose to attach additional trim to the walls of the building. For instance, additional trim can conceal seams, edges, and openings in the walls, which accommodate doors, windows, etc. Trim can also be used as base board, crown molding, and other aesthetic, decorative, or structural features. A typical installation of trim (e.g., installation of baseboard) involves measuring, cutting, fitting, shimming, and adjusting the trim of the wall, which can take a substantial amount of time and effort to complete. Furthermore, the installer may need to have sufficient skill to correctly and accurately perform the installation.

In addition, the trim is typically nailed, screwed, or glued onto the wall, ceiling, floor, doorway, or other structural component to which it is attached. Such trim is not designed to be removable or reusable, and is typically damaged beyond repair by detachment from the wall. In addition, the nail or screw (head) must then be sunk, puttied (or covered), and painted over in order to conceal them from view (e.g., for aesthetic and/or safety reasons). Such concealment also can be time-consuming and may require an experienced installer. Moreover, the concealment may not always be perfect, and an occupant of the building may see undesirable marks on the trim.

Accordingly, there are a number of disadvantages with conventional construction or finishing trim systems that can be addressed.

BRIEF SUMMARY

Implementations of the present disclosure solve one or more of the foregoing or other problems in the art with systems, methods, and apparatus for attaching trim to structural components, and specifically to modular wall components including walls, ceilings, floors, door frames, window frames, etc. and other structures, such as furniture, lower height furniture scale construction, etc. In particular, one or more implementations can include a snap-in trim system for securing a trim element to a structural component of a building or building space. The trim system can include a mounting element securable to or integrated with the structural component, a connection element securely coupleable to the mounting element, and a trim element attachable to or integrated with the connection element.

The connection element can include an alignment element for ensuring proper positioning, orientation, and/or alignment of the trim element relative to the connection element, structural component, and/or (modular) wall component(s) in some embodiments. A trim element (reversibly and/or integrally) connected to the connection element can form a trim assembly. In at least one embodiment, an integral trim assembly can comprise a trim element seamlessly connected to a connection element and/or unitary therewith. In some embodiments, a reversibly connected trim assembly can comprise a separate connection element attached to the trim element. The trim element can comprise industry-standard (solid) wood or medium-density fiberboard (MDF) in some embodiments. Accordingly, implementations of the present disclosure can integrate existing and/or permanent trim elements into modular or reconfigurable wall systems.

In some implementations, the mounting element can extend longitudinally along a length of the structural component. In at least one implementation, the connection element can be securely coupled to the mounting element such that the connection element can slide longitudinally along the length of the structural component while remaining securely coupled to the mounting element. For instance, the mounting element can comprise one or more mounting members (e.g., recessed channels, tracks, strips, or protrusions).

The connection element can comprise one or more connection members corresponding to the configuration of the mounting member(s). In certain implementations, the connection element can attach to the mounting element at an attachment interface in an attachment direction either anterior-perpendicularly, lateral-parallelly, or anterior-lateral-diagonally to the interface. Accordingly, the attached connection element can form or accommodate (tight and/or gapless) joints or abutments between a trim element and an intersecting trim element and/or (modular) wall component.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the disclosure and are not therefore to be considered to be limiting of its scope, the disclosure will be described and explained with additional specificity and detail through the use of the accompanying drawings in which:

FIGS. 12A-17 illustrate various components of a snap-in trim system according to still another implementation of the present disclosure;

DETAILED DESCRIPTION

Figure 1A:
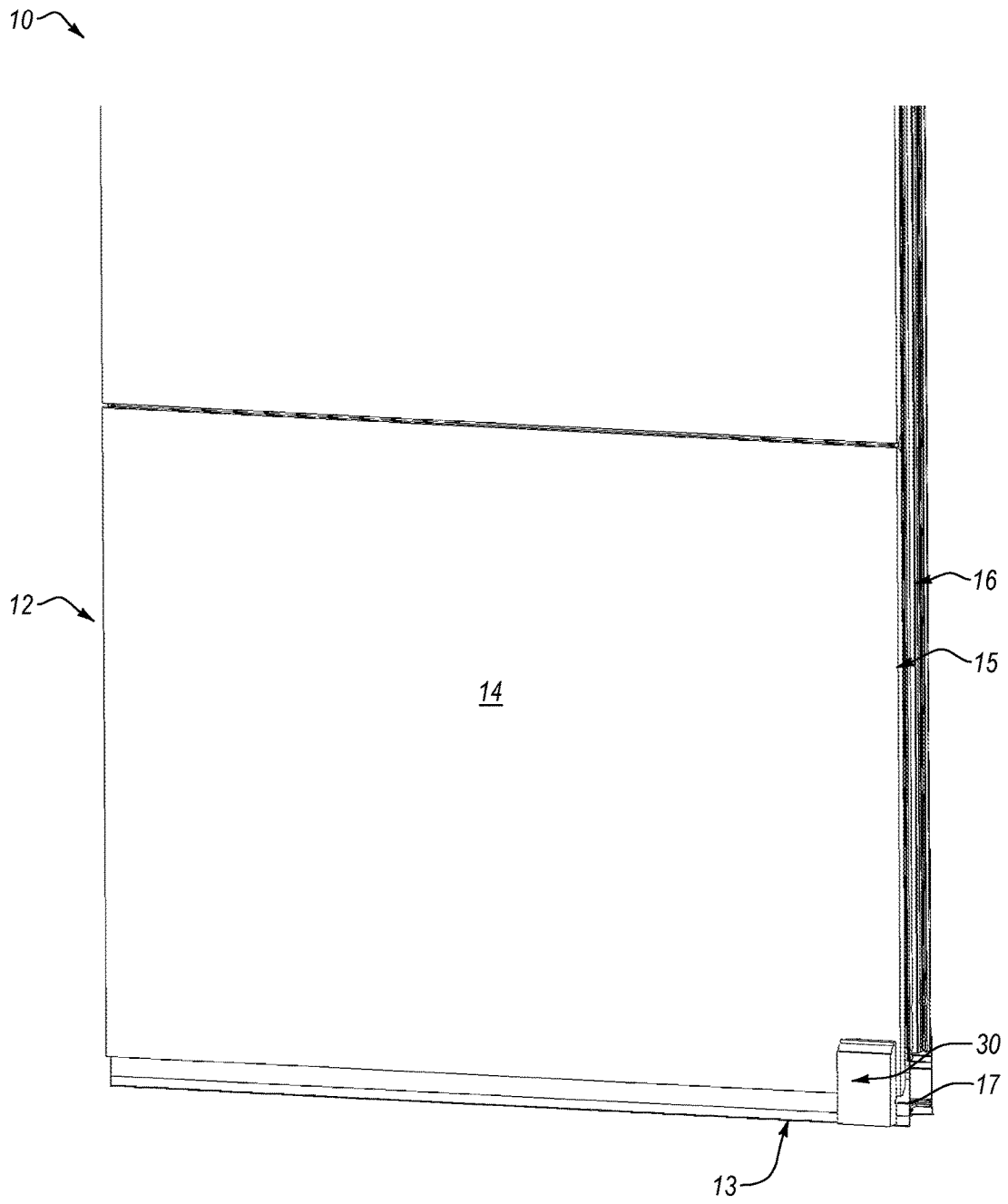
FIG. 1A illustrates a front perspective view of a trimmed wall according to an implementation of the present disclosure.

Before describing various implementations of the present disclosure in detail, it is to be understood that this disclosure is not limited to the parameters of the particularly exemplified systems, methods, apparatus, products, processes, and/or kits, which may, of course, vary. Thus, while certain implementations of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the implementations, and is not necessarily intended to limit the scope of the claimed invention.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the terms "embodiment" and "implementation" mean serving as an example, instance, or illustration, and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used herein, the term "systems" also contemplates devices, apparatus, compositions, assemblies, kits, and vice versa. Similarly, the term "method" also contemplates processes, procedures, steps, and vice versa. Moreover, the term "devices" also contemplates products, apparatus, compositions, assemblies, kits, and vice versa.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "seam" includes one, two, or more seams. Similarly, reference to a plurality of referents should be interpreted as comprising a single referent and/or a plurality of referents unless the content and/or context clearly dictate otherwise. Thus, reference to "seams" does not necessarily require a plurality of such seams. Instead, it will be appreciated that independent of conjugation; one or more seams are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," "joined," "communicating," or "in communication" are used to indicate either a direct association between two components or, where appropriate, an indirect association with one another through intervening or intermediate components. In contrast, when a component is referred to as being "directly bound," "directly coupled", "directly attached", "directly connected," "directly joined," "directly communicating," or "in direct communication" to or with another component, no intervening elements are present or contemplated. Furthermore, binding, coupling, attaching, connecting, joining, or communicating can comprise mechanical and/or electrical association.

To facilitate understanding, like reference numerals (i.e., like numbering of components and/or elements) have been used, where possible, to designate like elements common to the figures. Specifically, in the exemplary implementations illustrated in the figures, like structures, or structures with like functions, will be provided with similar reference designations, where possible. Specific language will be used herein to describe the exemplary implementations. Nevertheless it will be understood that no limitation of the scope of the disclosure is thereby intended. Rather, it is to be understood that the language used to describe the exemplary implementations is illustrative only and is not to be construed as limiting the scope of the disclosure (unless such language is expressly described herein as essential).

Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular implementation(s) in which they are illustrated. In other words, reference to a specific feature in relation to one implementation and/or embodiment should not be construed as being limited to applications only within said implementation.

The headings used herein are for organizational purposes only and are not meant to be used to limit the scope of the description or the claims.

The present disclosure extends to systems, methods, and apparatus for attaching trim to structural components, and specifically to modular wall components including walls, door frames, window frames, etc. In particular, one or more implementations can include a snap-in trim system for securing a trim element, such as base board, crown molding, window casing, or door framing components to a structural component, such as a (modular) wall, of a building. The trim system can include a mounting element securable to or integrated with the structural component, a connection element securely coupleable to the mounting element, and a trim element attachable to or integrated with the connection element.

The connection element can include an alignment element for ensuring proper positioning, orientation, and/or alignment of the trim element relative to the connection element, structural component, and/or (modular) wall component(s) in some embodiments. A trim element (reversibly and/or integrally) connected to the connection element can form a trim assembly. In at least one embodiment, an integral trim assembly can comprise a trim element seamlessly connected to a connection element and/or unitary therewith. In some embodiments, a reversibly connected trim assembly can comprise a separate connection element attached to the trim element. The trim element can comprise industry-standard (solid) wood or medium-density fiberboard (MDF) in some embodiments. Accordingly, implementations of the present disclosure can integrate existing and/or permanent trim elements into modular or reconfigurable wall systems.

In some implementations, the mounting element can extend longitudinally along a length of the structural component (or wall). In at least one implementation, the connection element can be securely coupled to the mounting element such that the connection element can slide longitudinally along the length of the structural component while remaining securely coupled to the mounting element. For instance, the mounting element can comprise one or more mounting members (e.g., recessed channels, tracks, strips, or protrusions).

The connection element can comprise one or more connection members corresponding to the configuration of the mounting member(s). In certain implementations, the connection element can attach to the mounting element at an attachment interface in an attachment direction either anterior-perpendicularly, lateral-parallelly, or anterior-lateral-diagonally to the interface. Accordingly, the attached connection element can form or accommodate (tight and/or gapless) joints or abutments between a trim element and an intersecting trim element and/or (modular) wall component. Such joints or abutments can be mitered or butted.

Figure 1B:
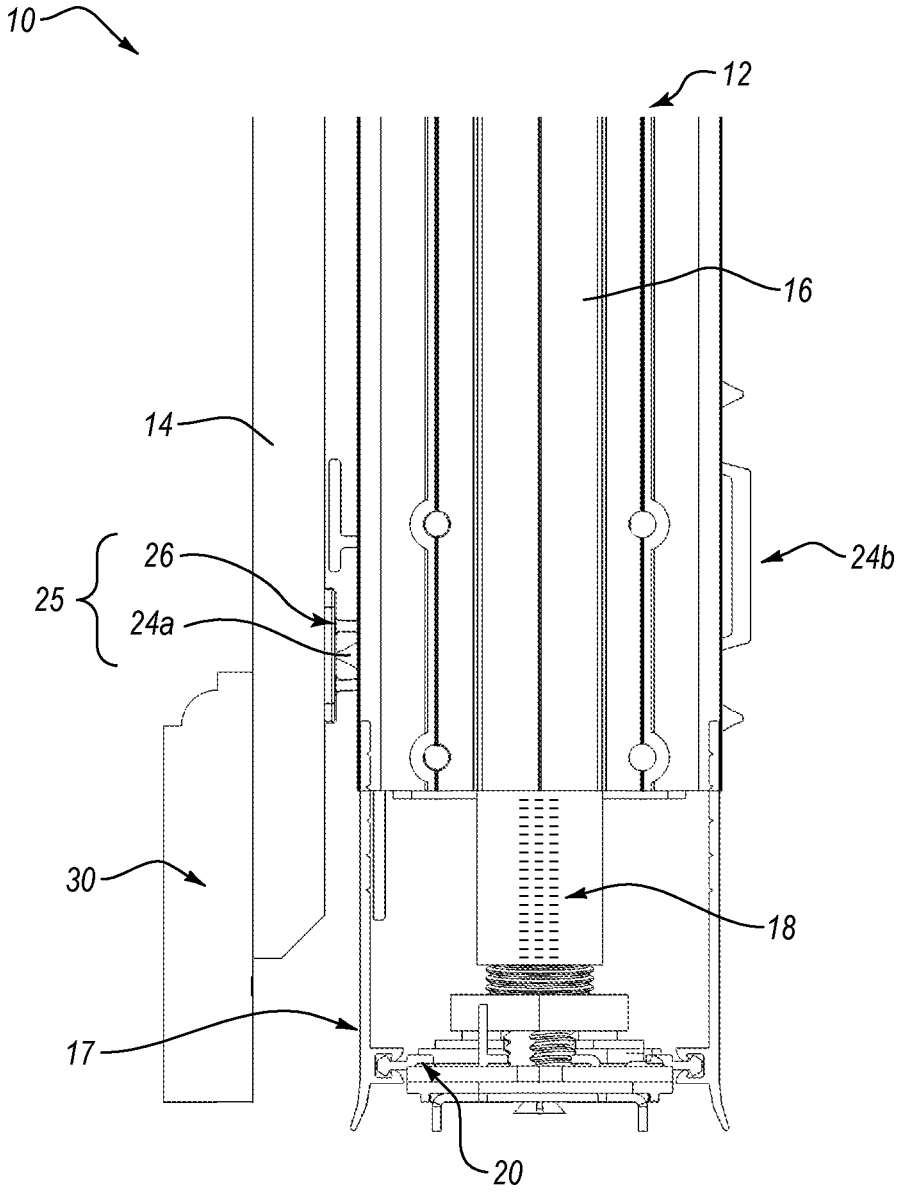
FIG. 1B illustrates a detailed side elevation view of the trimmed wall of FIG. 1A.

Reference will now be made to the figures of the present disclosure. For example, FIGS. 1A-1B illustrate a wall system 10 comprising a wall (or wall module) 12 and a trim (or trim element) 30. As depicted, trim element 30 comprises a baseboard formed of (solid) wood, MDF, etc. However, as discussed in further detail below, trim elements according to certain embodiments of the present disclosure can also or alternatively comprise crown molding, chair railing, wainscoting, window casing, door casing or other doorway components, and/or any other type of decorative and/or structural trim.

Wall 12 can comprise a modular wall assembly, comprising a structural component (or frame) 16 and one or more outer wall components (or panels) 14 connected to structural component 16. Structural component 16 can include an attachment component 17 (e.g., attached by means of a coupling element 20). Trim element 30 can be attached to attachment component 17 and/or wall component 14 of wall 12 by means of a fastener, such as an adhesive and/or one or more nails, screws, etc. Such fasteners can, however, damage wall component 14 and/or trim element 30. Trim element 30 can be attached to wall 12 such that the lower edge of trim element 30 is aligned with and/or rests on a floor 13.

Accordingly, any gap between wall component 14 and the floor 13 can be concealed or covered by trim element 30 from a facing vantage point. In some embodiments, the side edge of trim element 30 can also be aligned with an end 15 of wall 12, structural component 16, and/or wall component 14.

As depicted in FIG. 1B, wall component 14 can be attached to structural component 16 of wall 12 by means of an attachment mechanism 25. Attachment mechanism 25 can include, for example, a mounting component 24*a* (e.g., attached to structural component 16) and a connection component 26 (e.g., attached to wall component 14). An alternative mounting component 24*b* can be configured to accommodate and/or connect with a plurality of connection components 26. FIG. 1B also illustrates a base element 18 of structural component 16. Base element 18 can be configured for mounting wall 12 or structural component 16 thereof to or above a floor or sub-floor.

Figure 2A:
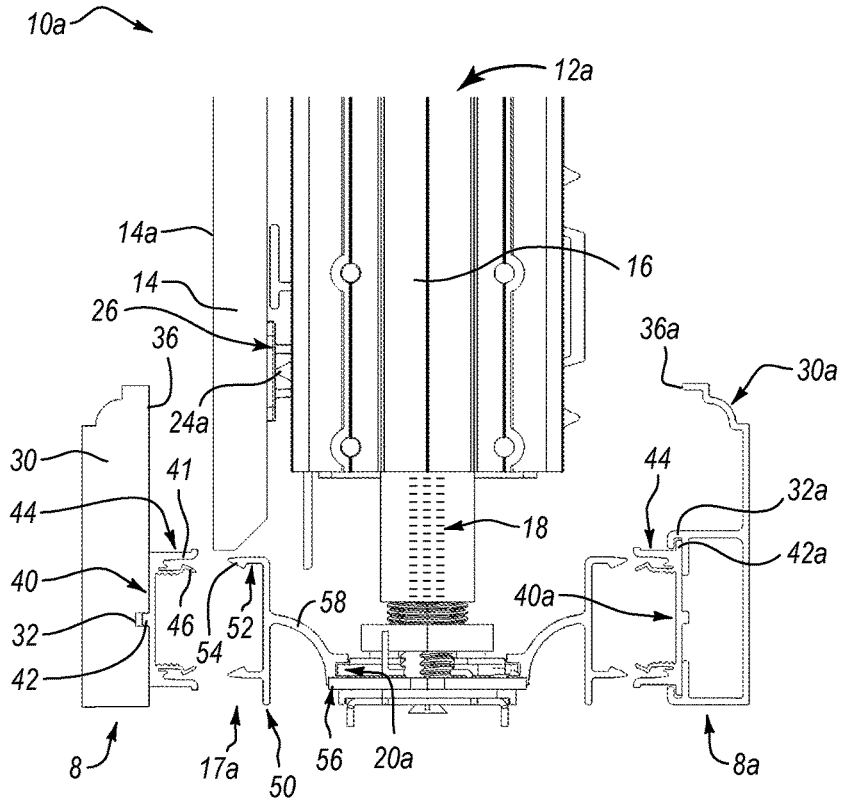
FIGS. 2A-2B illustrate side cross-sectional views of a snap-in trim system in a detached (2A) and attached (2B) configuration according to an implementation of the present disclosure.
Figure 2B:
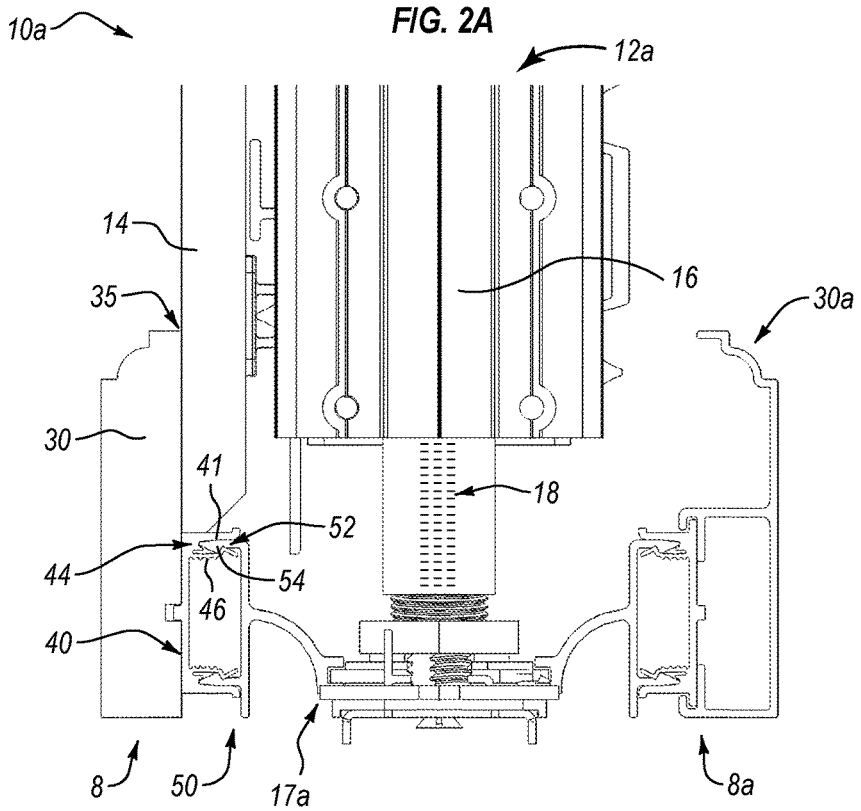

FIGS. 2A and 2B illustrate an alternative implementation comprising a snap-in trim wall system 10*a*, comprising a wall assembly 12*a*, having a structural (frame) component 16 and one or more (e.g., opposing) wall (panel) elements 14 with an outer wall surface 14*a*. Wall assembly 12*a* can be similar to wall 12 of FIGS. 1A-1B in many respects. For instance, wall panel(s) 14 can have one or more connection components 26 attached thereto (e.g., to an inner wall surface opposite outer wall surface 14*a*) and frame 16 can have one or more (corresponding) mounting components 24*a* present so as to interface with, receive, and/or attach to connection component(s) 26. Unlike wall system 10, however, wall system 10*a* includes a coupling element 20*a* for joining an attachment component 17*a* with structural component 16 by means of a joining element 56.

Attachment component 17*a* comprises one or more (e.g., opposing) mounting elements 50, comprising one or more (e.g., upper and lower) mounting members 52. Mounting member 52 can include a retention element (or catch) 54 in some implementations. In certain implementations, a spacing member 58 can separate mounting element 50 from coupling element 20*a* by a predetermined distance. As depicted, spacing member 58 can have a curved (upward) configuration (e.g., in order to raise mounting element 50 (or mounting member(s) 52 thereof) above coupling element 20*a* and/or the floor or sub-floor.

Snap-in trim wall system 10*a* also comprises a trim assembly 8 and/or a trim assembly 8*a*. FIG. 2A depicts the wall system 10*a* with a snap-in (base board) trim assembly 8, 8*a* in a detached configuration. Trim assembly 8 includes a connection element 40, which can be attached to a trim element 30. For instance, connection element 40 can be attached to trim element 30 by means of one or more fasteners, such as an adhesive, a (pressure fit) socket and insert, staple, etc. As illustrated in FIG. 2A, for instance, trim element 30 can include a receiving element 32, and connection element 40 can include an alignment element 42.

Receiving element 32 can comprise a recessed channel extending along a longitudinal length of an inside face of trim element 30. Alignment element 42 can comprise a protrusion extending from an outer face of connection element 40 and sized and/or configured to be pressure fit within receiving element 32, such that connection element 40 becomes attached to trim element 30. Alternatively, or in addition, alignment element 42 may properly align connection element 40 with and/or on trim element 30 by means of insertion into receiving element 32 with or without a pressure fit, which may then prepare trim assembly 8 for subsequent fastening.

Figure 7A:
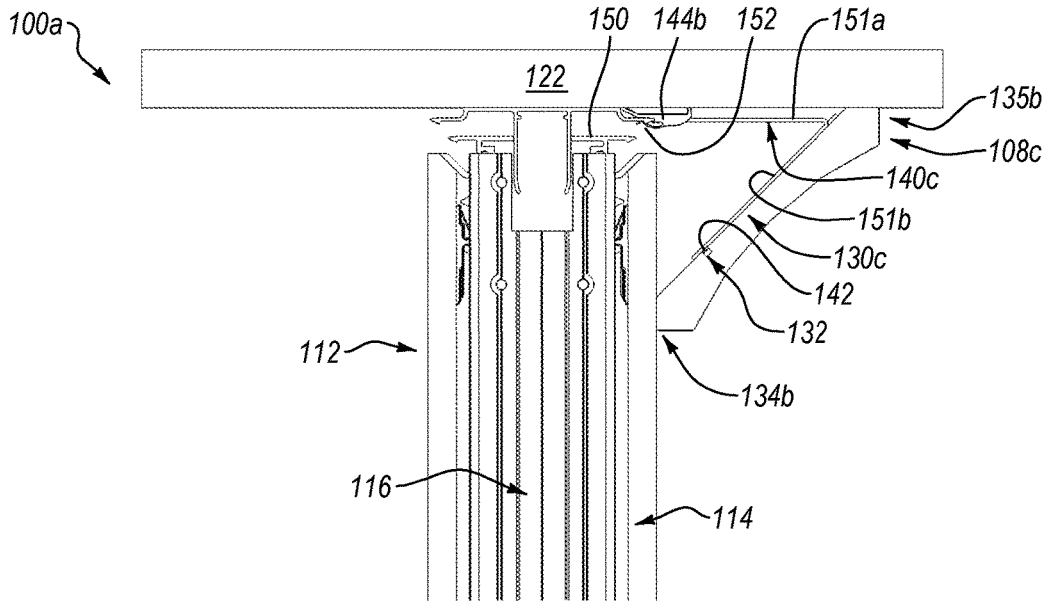
FIGS. 7A-7B illustrate side cross-sectional views of the snap-in trim system in an attached (7A) and detached (7B) configuration in a wall environment according to another implementation of the present disclosure.
Figure 7B:
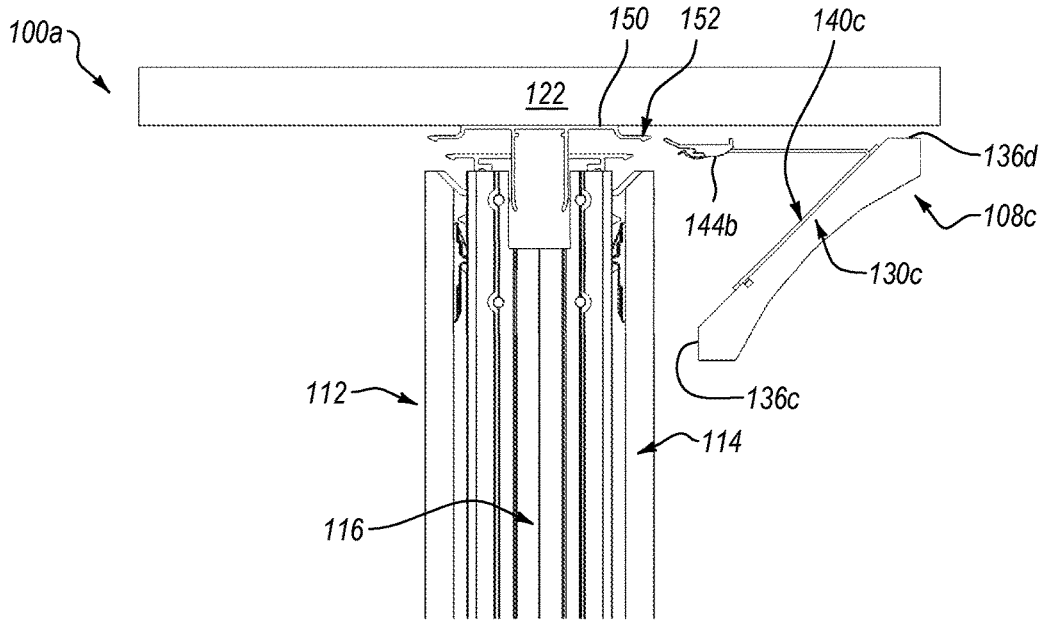
Figure 7C:
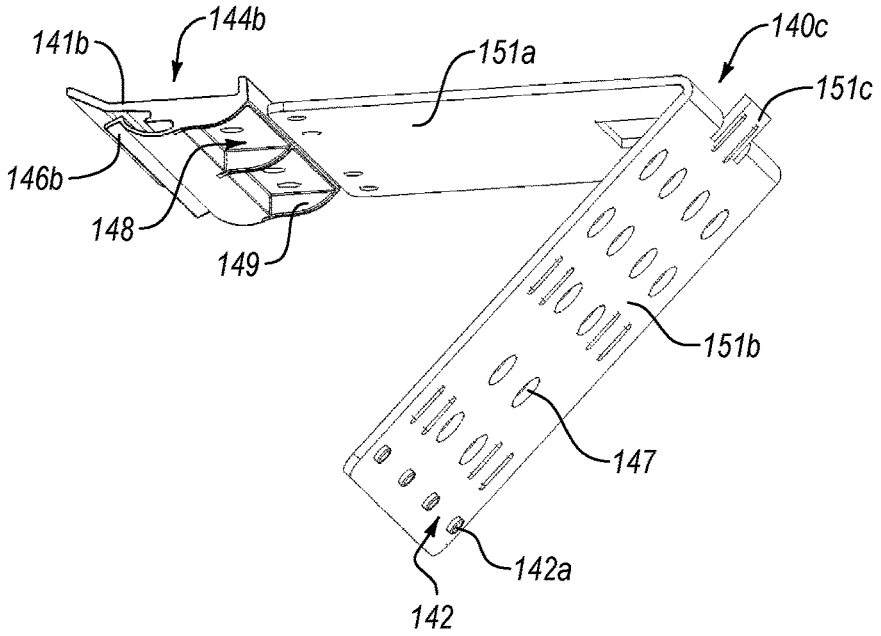
FIGS. 7C-7D illustrate an exploded view of a connection element according to still another implementation of the present disclosure.
Figure 7D:
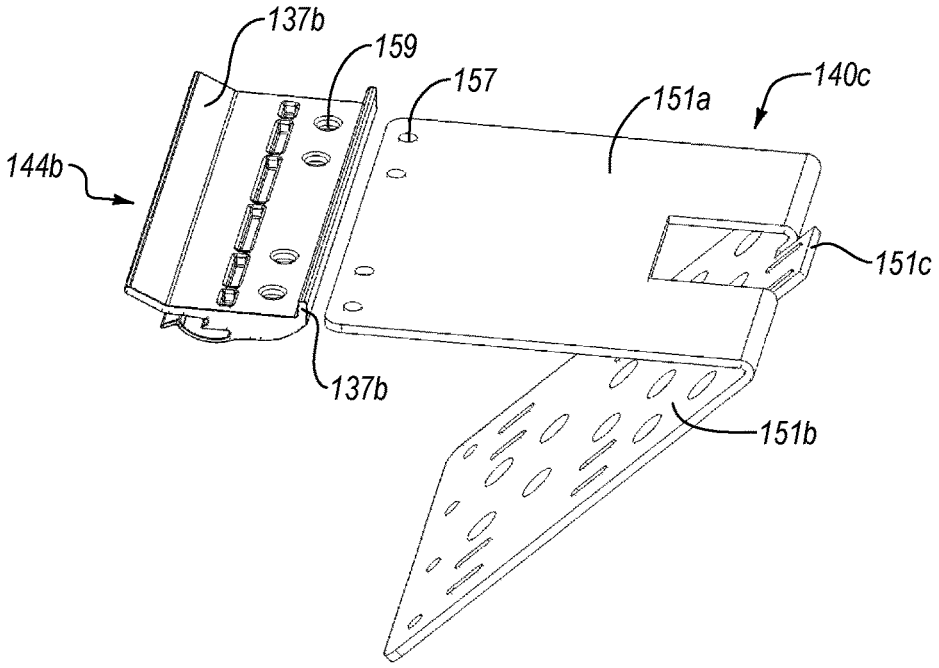
Figure 7E:
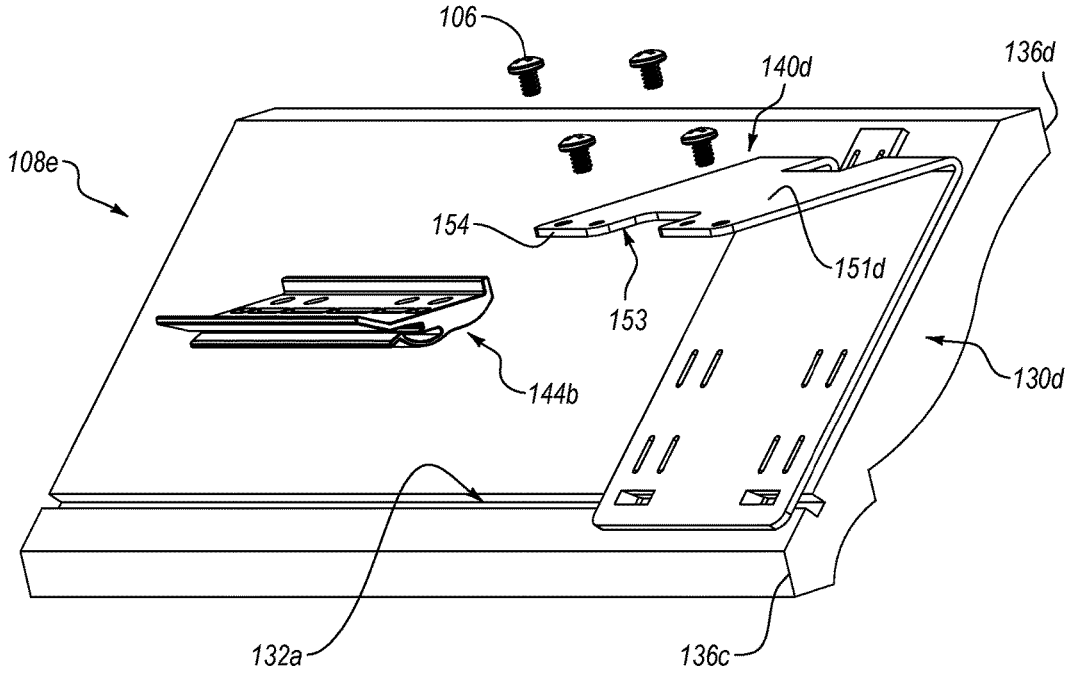
FIG. 7E illustrates an exploded view of a trim assembly according to another implementation of the present disclosure.

Those skilled in the art will appreciate that receiving element 32 can comprise a channel running longitudinally along the back side and/or surface of trim element 30 (see e.g., FIG. 7E). Such a channel can be formed (e.g., cut, routed, etc.) into the rear surface of trim element 30 (e.g., by means of a saw or other cutting or material removing device. Alignment element 42 can be inserted into receiving element 32 slidably (from a longitudinal side edge) or laterally (from a facing side). It will also be appreciated that in an alternative implementations trim element 30 can include alignment element 42 and connection element 40 can include receiving element 32.

An alternative embodiment can include a trim assembly 8*a*, comprising a connection element 40*a* attached to a trim element 30*a*. Trim element 30*a* can have an outer profile substantially similar and/or identical to trim element 30. However, trim element 30*a* can comprise or be comprised of one or more metals, such as aluminum, or metal alloys, such as an aluminum alloy (e.g., instead of wood or MDF) in some implementations. For example, trim element 30*a* can be made or formed (entirely or partially) of extruded aluminum. In other implementations, trim element 30*a* can comprise or be comprised, formed, or made of (extruded) polymeric (e.g., plastic) material. In certain implementations, trim element 30*a* can be injection molded, die-cast, milled, manufactured, fabricated, or otherwise formed of any suitable material.

In addition, trim element 30*a* can comprise a substantially hollow configuration in some implementations. Accordingly, trim element 30*a* can be lightweight, durable, flexible, etc. Moreover, trim element 30*a* can include one or more (e.g., upper and lower) receiving elements 32*a* for receiving one or more (e.g., upper and lower) alignment element 42*a* of connection element 40*a*. As depicted, each receiving elements 32*a* comprises or forms a channel and each alignment element 42*a* comprises or forms a protrusion, which can be (slidably) insertable into the channel from a longitudinal side edge. However, other attachment mechanisms, such as snap-fit, lateral insertion, fastener coupling, such as screws, staples, adhesives, etc. are also contemplated herein.

Connection elements 40, 40*a* can also include one or more (e.g., upper and lower) connection members 44. Connection member 44 can be configured to mate with mounting member 52 so as to securely and/or reversibly attach connection element 40 and mounting element 50. For instance, connection member 44 can include a (more rigid) support body or member 41 and a (more (resiliently) flexible) retention member 46 configured to interact with and/or receive retention element 54 in order to inhibit and/or substantially prevent inadvertent detachment of connection element 40 from mounting element 50. In at least one implementation, retention member 46 can be at least partially biased towards support member 41, such that retention member 46 returns towards support member 41 when a separating force (away from support member 41) is removed.

As illustrated in FIG. 2B, for example, trim assembly 8 can be attached to wall assembly 12*a* (at an interface 35 with wall panel 14 or surface 14*a* thereof) by attaching connection element 40 to mounting element 50. Likewise, trim assembly 8*a* can be attached to wall assembly 12*a* (at an opposing interface) by attaching connection element 40*a* to mounting element 50. In particular, mounting member 52 can be received within connection member 44 such that retention member 46 interacts with retention element 54 to inhibit and/or substantially prevent inadvertent detachment of connection element 40 from mounting element 50. As depicted, retention member 46 and/or retention element 54 can (each) comprise a sloping front surface and/or a rear lip or flange, such that the front surface of retention element 54 can slide over the front surface of retention member 46.

In at least some implementations, retention member 46 can flex away from support member 41 as the front surface of retention element 54 slides over the front surface of retention member 46. Once the front surface of retention element 54 slides over the front surface of retention member 46, retention member 46 can snap back towards support member 41, behind retention element 54. In such a configuration, the rear lip or flange of retention member 46 can interact with the rear lip or flange of retention element 54 to inhibit and/or substantially prevent inadvertent detachment of connection element 40 from mounting element 50.

The fit(s) or connection(s) between mounting element 50 (or components thereof), connection elements 40, 40*a* (or components thereof), and/or trim elements 30, 30*a* can provide and/or ensure a tight, flush, and/or gapless, connection between trim assembly 8, 8*a* and wall assembly 12*a* (or between trim elements 30, 30*a* and wall element 14). For instance, connection member 44 can also include one or more inner sockets configured to receive a distal tip of retention element 54 therein and/or provide (back) pressure or force between the rear lip or flange of retention member 46 and retention element 54. In addition, base element 18 and/or the position of wall component 14 can be vertically adjusted to ensure that trim elements 30, 30*a* are disposed properly relative to the wall component 14 and/or floor 13 (see FIG. 1A).

As depicted in FIG. 2A, trim assembly 8 (or trim element 30 thereof) can have an (inner surface) end 36. Similarly, trim assembly 8*a* (or trim element 30*a* thereof) can have an (inner surface) end 36*a*. It is noted that trim assemblies 8 and 8*a* can each be configured (e.g., sized and/or shaped, etc.) to attach (e.g., securely snap or lock in place) to mounting element 50 such that end 36, 36*a* associates with, contacts, touches, becomes flush with, or is (closely) adjacent to (the surface of) wall assembly 12 (or wall panel 14, or outer wall surface 14*a* thereof), at interface 35. Accordingly, trim assemblies 8 and 8*a* can provide (tight-fitting, interchangeable, snap-in) trim element(s) that have a standard installation appearance, but without the need for typical or customary trim fasteners (e.g., finishing nails, staples, screws, adhesives, etc.), which may damage the trim or structural element and/or leave holes that require additional time, expense, and effort to fill (e.g., putty) and paint (see e.g., FIG. 1A-1B).

Figure 3:
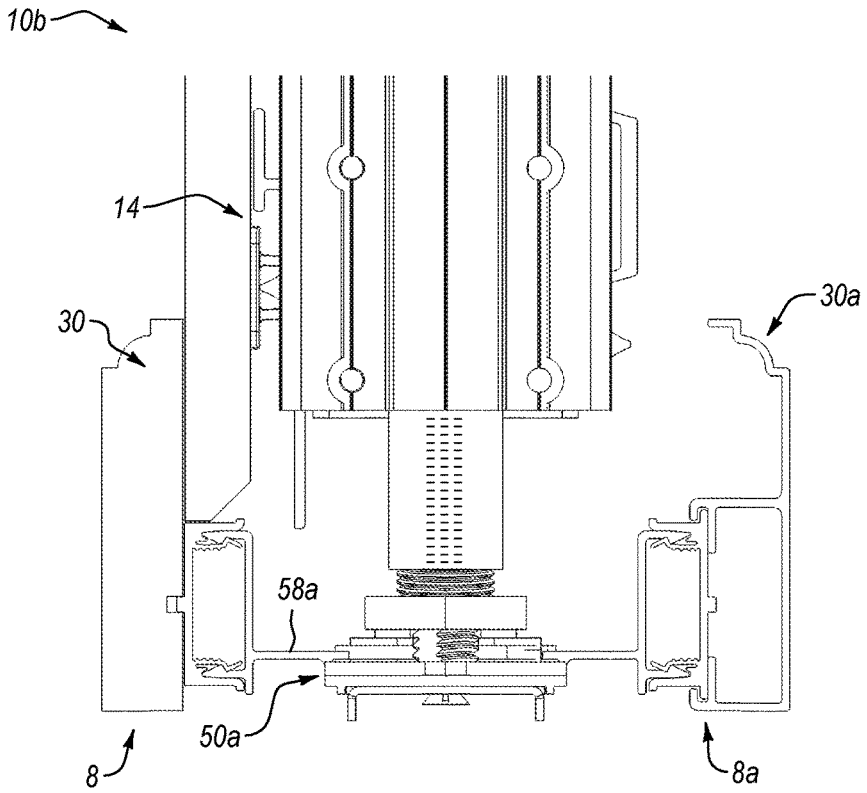
FIG. 3 illustrates a side cross-sectional view of a snap-in trim system in an attached configuration according to another implementation of the present disclosure.

FIG. 3 illustrates an alternative wall system 10*b* in which mounting element 50*a* includes a spacing member 58*a* having a substantially linear and/or horizontal configuration. Accordingly, in at least one implementation, mounting elements 50, 50*a* can be selected to accommodate a variety of wall component 14 and/or floor 13 positions.

Figure 4:
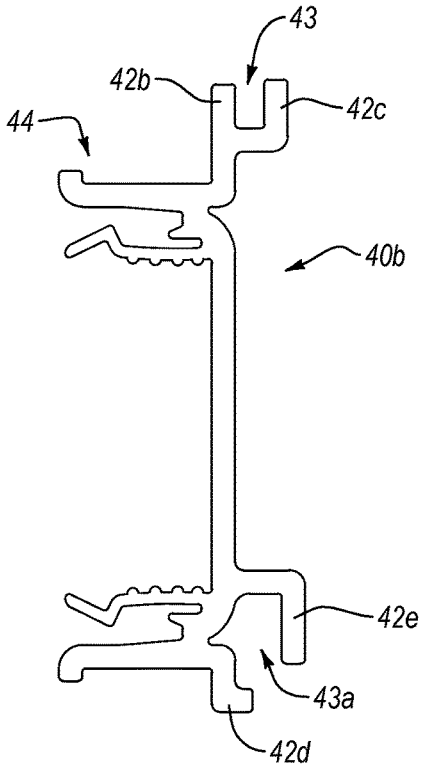
FIG. 4 illustrates a cross-sectional of a connection element according to an implementation of the present disclosure.

FIG. 4 illustrates an alternative connection element 40*b*. Similar to connection element 40, connection element 40*b* has opposing (upper and lower) connection members 44. However, unlike connection element 40, connection element 40*b* has two upper alignment elements 42*b*, 42*c*, which form an alignment channel 43, and two lower alignment elements 42*d*, 42*e*, which form an alignment channel 43*a*. It will be appreciated that alignment elements 42*c* and 42*e* can fit within respective upper and lower receiving elements 32*a*. Alignment elements 42*b* and 42*d* can provide additional support and/or alignment with or against the side wall(s) of respective upper and lower receiving elements 32*a*.

It will be appreciated that at least one implementation of the present disclosure can comprise a wall (baseboard) trim assembly kit, comprising one or more of the components described herein, or a method of installation.

Figure 5A:
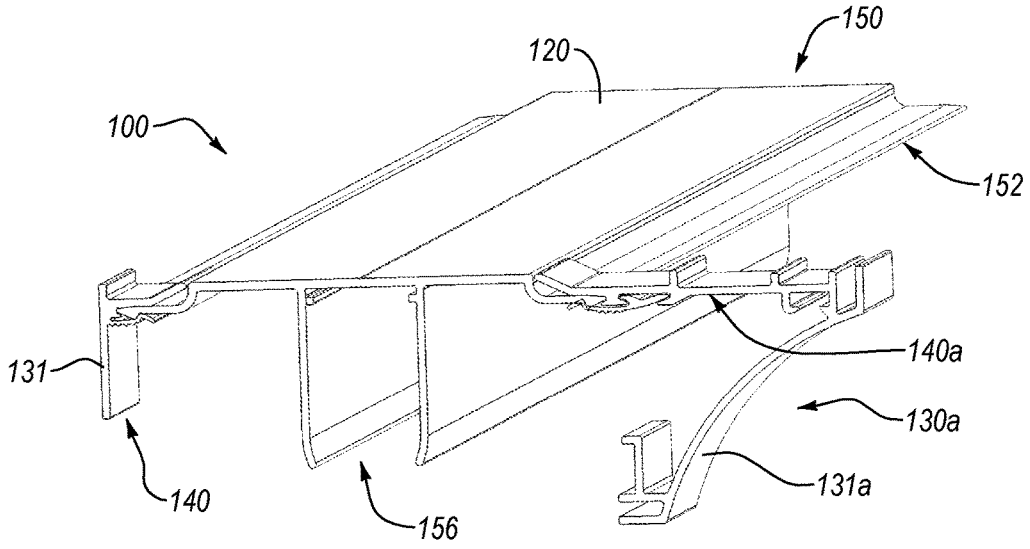
FIG. 5A illustrates a perspective view of certain components of a snap-in trim system according to yet another implementation of the present disclosure.

FIG. 5A illustrates a perspective view of an alternative snap-in trim system 100 in accordance with an implementation of the present disclosure. Trim system 100 can comprise a crown molding installation system in certain implementations. For instance, trim system 100 can include a mounting element 150 having an upper surface 120, a (wall) joining element 156, and/or one or more mounting members 152. Trim system 100 can also include one or more trim assemblies 108, 108*a*, comprising trim elements 130, 130*a* and/or connection elements 140, 140*a* (e.g., reversibly attached to mounting element 150 and/or mounting member 152 thereof), respectively.

Figure 5B:
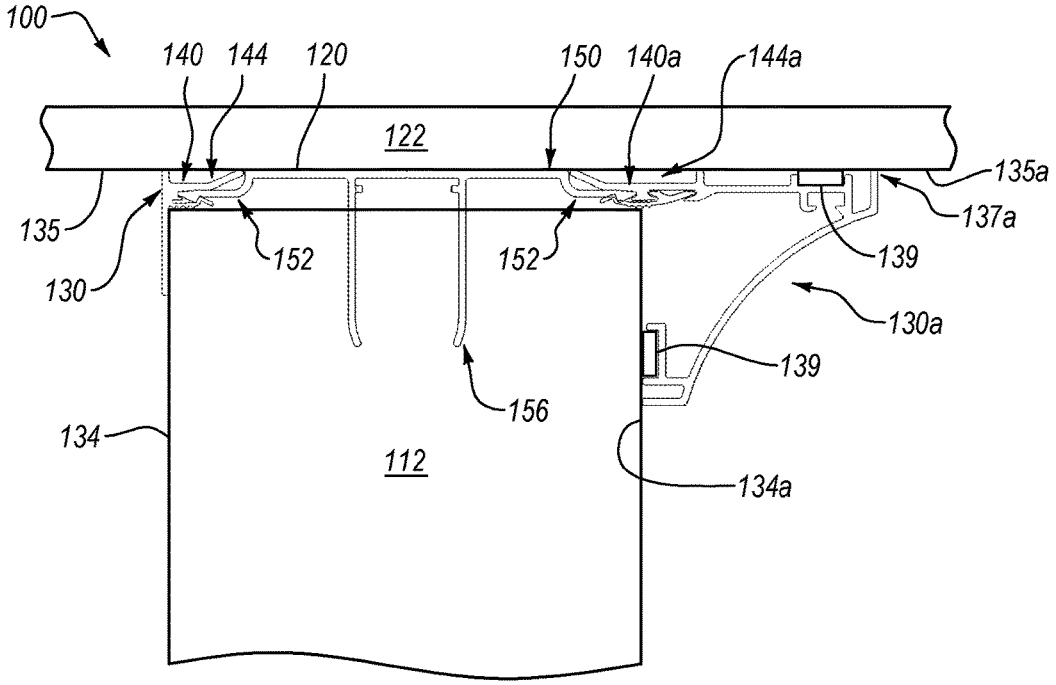
FIGS. 5B-5C illustrate side cross-sectional views of the snap-in trim system of FIG. 5A in an attached (5B) and detached (5C) configuration in a wall environment.
Figure 5C:
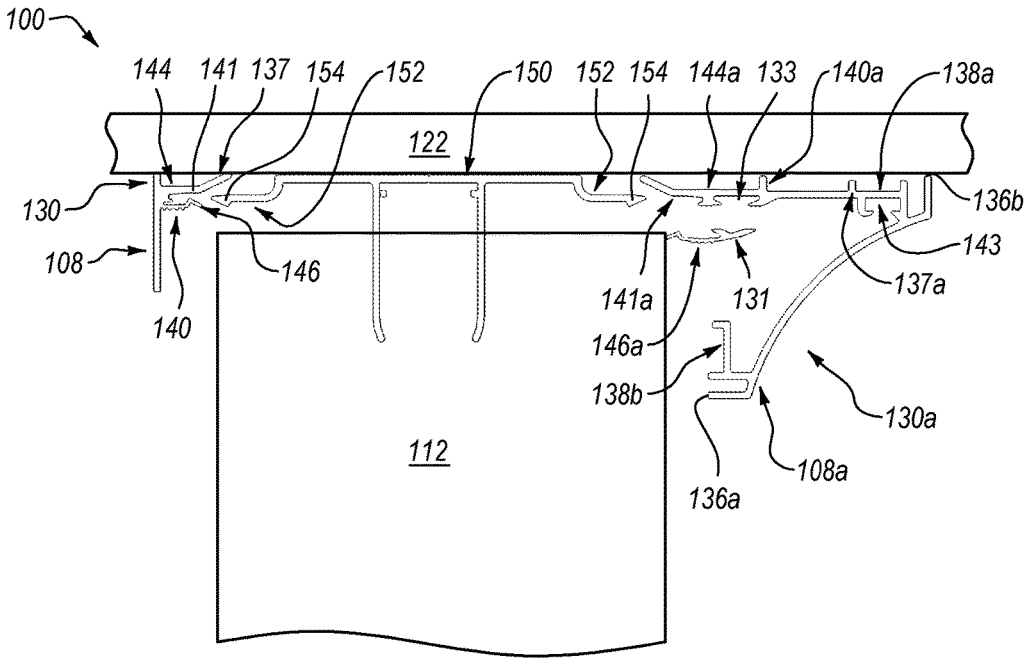

As illustrated in FIGS. 5B and 5C, mounting element 150 can be connected to a (modular) wall assembly 112 (or frame 116 thereof; see FIGS. 7A-7B) by means of joining element 156. In addition, mounting element 150 can be connected to a ceiling element 122 by means of upper surface 120 of mounting element 150 (e.g., such as with one or more fasteners).

In at least one implementation, connection element 140 can be integrally formed with (a simply and/or minimal) trim element 130, forming trim assembly 108. For instance, connection element 140 can be unitarily formed with and/or disposed at an angle relative to trim element 130 and/or extend at an angle therefrom. In at least some embodiments, the angle can be about 90°. In particular, the (90°) angle between connection element 140 and trim element 130 can accommodate and/or allow for trim assembly 108 to be attached to mounting element 150 such that trim element 130 substantially conceals a gap disposed between (respective surfaces of) ceiling element 122 and wall assembly 112 (or wall element 114 thereof; see FIGS. 7A-7B).

Trim element 130 can have a substantially flat or linear configuration (e.g., extending substantially parallel to the surface of wall assembly 112 (or wall element 114 thereof) and substantially perpendicular to the surface of ceiling 122. Connection element 140 can be coupled with mounting member 152 of mounting element 150 such that attachment of connection element 140 to mounting element 150 connects and/or positions trim element 130 with and/or against wall assembly 112 (or wall element 114 thereof) at first attachment interface 134, and with and/or against ceiling element 122 at a second attachment interface 135. As depicted, second attachment interface 135 can be aligned with (e.g., (directly) above) first attachment interface 134.

It will be appreciated that trim element 130 can have a low-profile and/or minimalistic configuration adapted to reduce visibility or attention of trim element 130 while still covering, concealing, or hiding the gap disposed between (respective surfaces of) ceiling element 122 and wall assembly 112 (or wall element 114 thereof). Thus, trim element 130 can comprise a gap seal or cover in some implementations. In an alternative implementation, a separate trim element (not shown) may be attached to trim element 130 to provide an additional aesthetic.

As depicted in FIG. 5C, connection element 140 can include a connection member 144, comprising a support body or member 141 and a retention member 146. Mounting element 150 can also include a mounting member 152 having a retention element 154.

Connection element 140 can also include one or more spacing elements 137 (e.g., extending from an upper portion or surface thereof). In some embodiments, spacing element 137 can ensure an appropriate gap and/or spacing between connection member 144 and ceiling element 122, provide (downward) pressure or force of support body or member 141 against secured mounting member 152 (or retention element 154 thereof), or provide another structural support or other function. For instance, spacing element 137 can be or function as a positioning (or locating) element, such as a lead-in for retention element 154 (e.g., during installation of trim assembly 108). As depicted in FIG. 5B, for example, during (a blind) installation (e.g., where a view of mounting member 152 is blocked by trim assembly 108*a*) spacing element(s) 137 can guide or lead connection element 140 (or connection member 144 thereof) onto or about mounting member 152. Accordingly, a user can correctly position and/or secure connection element 140 (or connection member 144 thereof) onto mounting member 152. In addition, spacing element 137 can also (slightly or at least partially) depress mounting member 152 (e.g., into the space between support body or member 141 and retention member 146) during installation.

Alternatively, or in addition, spacing element 137 can be useful in a manufacturing process for connection element 140 that involves injection molding and/or extruding connection element 140. In particular, spacing element 137 can allow connection element 140 and/or components thereof to be extruded (e.g., from an injection mold) so as to reduce and/or substantially inhibit warping and/or other structural alteration of connection element 140.

In an alternative embodiment, trim assembly 108*a* can comprise a (curved) crown molding, in which a trim element 130*a* is seamlessly connected, integral, and/or integrated with at least a portion of connection element 140*a*. For instance, connection element 140*a* can extend from trim element 130*a* such that attachment of connection element 140*a* connects and/or positions trim element 130*a* with and/or against a wall element 114 at first attachment interface 134*a*, and with and/or against ceiling element 122 at a second attachment interface 135*a*. As depicted, second attachment interface 135*a* can be laterally and/or diagonally separated from first attachment interface 134*a* (e.g., because of the curved configuration of trim element 130*a*. Moreover, connection element 140*a* can be disposed at an angle relative to trim element 130*a* and/or extend at an angle therefrom. In at least some embodiments, the (curved) angle can be about 45°. In particular, the (generally 45°) angle between connection element 140*a* and trim element 130*a* can accommodate and/or allow for the attachment of trim element 130*a* to mounting element 150 so as to form a snap-in (crown molding) trim assembly.

Connection element 140*a* and/or trim element 130*a* can also include one or more spacing elements 137*a*. As illustrated in FIG. 5C, spacing elements 137*a* can form receiving area(s) 138*a* and/or 138*b*. As depicted in FIG. 5B, an insert (e.g., cushioning and/or buffering) element 139 can be positioned within receiving area(s) 138*a* and/or 138*b*. Insert 139 can comprise, for example, insulation, such as (an adhesive-backed, ⅜"×3/16", and/or open cell) foam material (or tape) configured to reduce and/or inhibit light and/or sound from passing thereby. Insert element 139 can also provide a protective barrier between ceiling element 122 and connection element 140*a* and/or between wall 112 (or wall element 114 thereof) and trim element 130*a*.

As further illustrated in FIG. 5C, trim assembly 108*a* (or connection element 140*a* thereof) can include a connection member 144*a* comprising a support body 141*a*, having a securing element 133. Trim assembly 108*a* (or connection element 140*a* thereof) can also include a separate retention member 146*a*, having a securing member 131. Securing member 131 can be configured to be secured to and/or within securing element 133 (e.g., to form connection member 144*a* of (the separate) support body 141*a* and retention member 146*a*). Together, integrally formed trim element 130*a* and connection element 140*a*, with separate retention member 146*a*, can form trim assembly 108*a*.

The outer profiles of trim assembly 108*a* (or trim element 130*a* thereof) can include a first (perpendicular) extension portion (having a first end 136*a*) that contacts and extends (perpendicularly) from wall assembly 112 at interface 134*a*, a second (perpendicular) extension portion (having a second end 136*b*) that contacts and extends (perpendicularly) from ceiling 122 at interface 135*a*, and a central, curved or rounded portion extending between the perpendicular extension portions in a curved arc. It is noted that trim assembly 108*a* can be configured (e.g., sized and/or shaped, etc.) to attach (e.g., securely snap or lock in place) to mounting element 150 such that (i) first end 136*a* (of trim element 130*a*) associates with, contacts, touches, becomes flush with, or is (closely) adjacent to (the surface of) wall assembly 112 (or wall panel 114 thereof) at interface 134*a*, and/or (ii) second end 136*b* (of trim element 130*a*) associates with, contacts, touches, becomes flush with, or is (closely) adjacent to (the surface of) ceiling 122 at interface 135*a*.

It will be appreciated that other assemblies, elements, components, etc. of the present disclosure can be similarly configured, such that one or more ends or surfaces of a snap-in trim element becomes associated with, contacts, touches, becomes flush with, or is (closely) adjacent to (the surface of) a wall, wall panel, floor, ceiling, door jamb, or other structural element. Accordingly, implementations of the present disclosure can provide (tight-fitting, interchangeable, snap-in) trim system(s) and element(s) that have a standard installation appearance, but without the need for typical or customary trim fasteners (e.g., finishing nails, staples, screws, adhesives, etc.), which may damage the trim or structural element and/or leave holes that require additional time, expense, and effort to fill (e.g., putty) and paint.

Figure 8A:
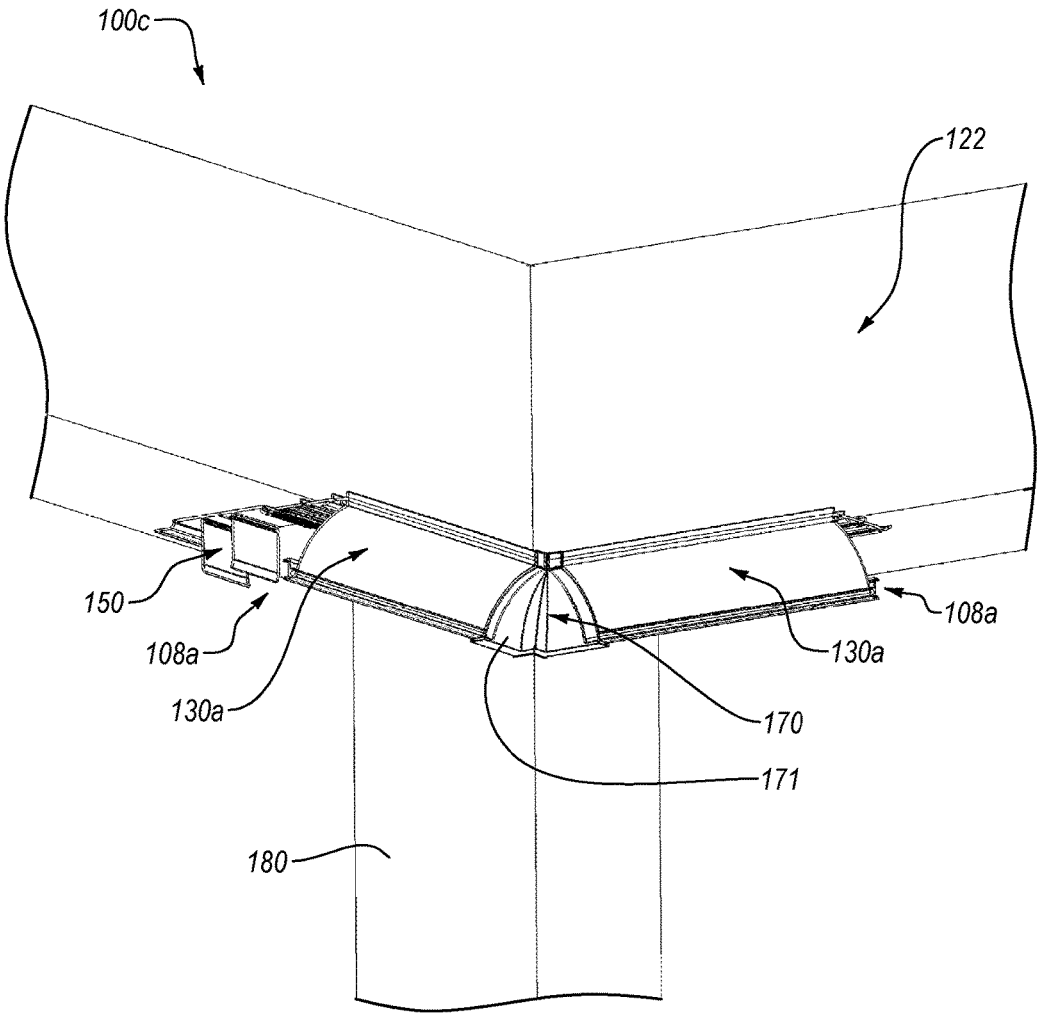
FIG. 8A illustrates a perspective view of a snap-in trim system in a corner environment according to another implementation of the present disclosure.

FIG. 5C further illustrates a (corner) securing component (or socket) 143 of trim assembly 108*a* (or connection element 140*a* thereof). As depicted in FIG. 8A, (adjacent) trim assemblies 108*a* can be disposed at a corner location in a building space. A securing component 143 of a first trim assembly 108*a* can be aligned with a securing component 143 of a second trim assembly 108*a* at the corner. Each securing component 143 can be adapted to receive a portion of a (corner) securing element.

Figure 5D:
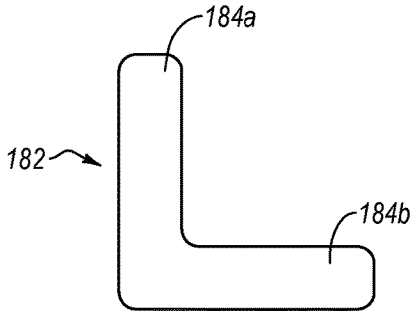
FIG. 5D illustrates a securing element according to an implementation of the present disclosure.

FIG. 5D illustrates an illustrative (corner) securing element 182. Securing element 182 can comprise a (L-shaped) spline or bracket, with a first arm 184*a* configured to extend into and fit within the securing component 143 of the first trim assembly 108*a* and a second arm 184*b* configured to extend into and fit within the securing component 143 of the second trim assembly 108*a*. The adjacent trim assemblies 108*a* can, thereby, by aligned and secured (tightly) together.

Figure 6:
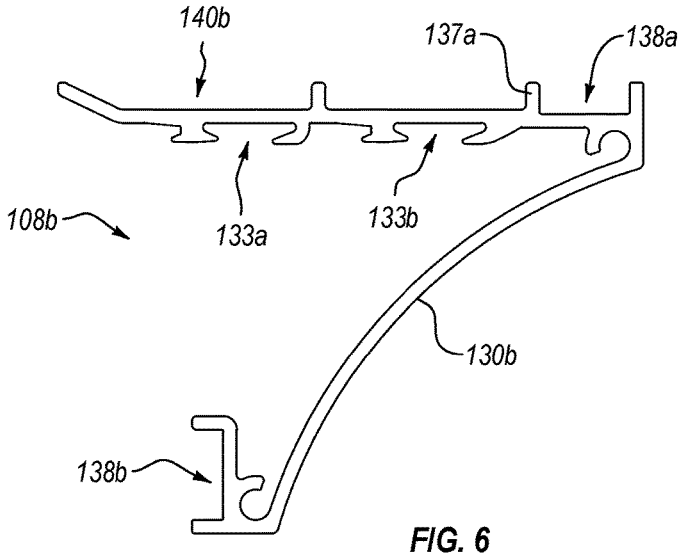
FIG. 6 illustrates a cross-sectional view of a trim assembly component according to another implementation of the present disclosure.

FIG. 6 illustrates an alternative configuration of a trim assembly 108*b*, comprising a trim element 130*b* seamlessly connected, integral, and/or integrated with at least a portion of a connection element 140*b*. As depicted in FIG. 6, spacing elements 137*a* can form receiving area(s) 138*a* and/or 138*b* disposed substantially terminally at interface ends of trim element 130*b*. Connection element 140*b* can also include a securing element 133*a*. A separate retention member 146*a* having a securing member 131, as described above, can be secured to and/or within securing element 133*a* (e.g., to form a connection member and/or trim assembly). A second securing element 133*b* can also be provided in some implementations (e.g., as an alternative location for receiving securing member 131 of retention member 146*a*).

Figure 6A:
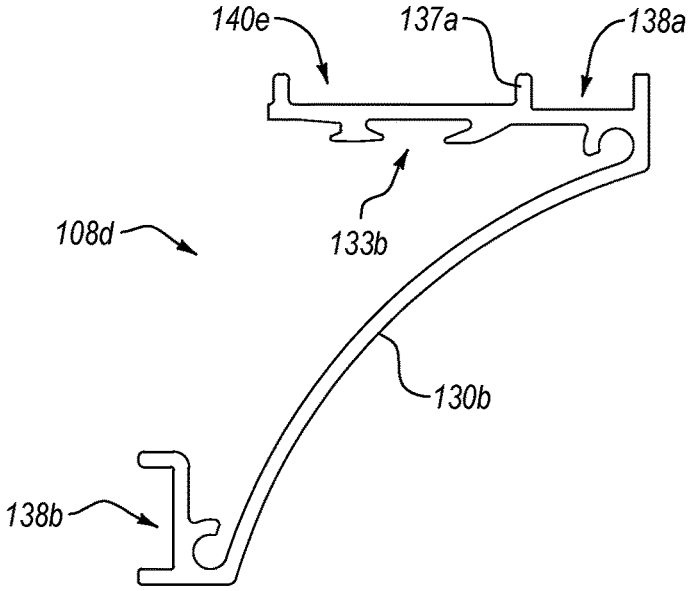
FIG. 6A illustrates a cross-sectional view of a trim assembly component according to another implementation of the present disclosure.

In addition, FIG. 6A illustrates an alternative trim assembly 108*d*, comprising trim element 130*b* and a (truncated) connection element 140*e*. In particular, trim assembly 108*d* can be formed by cutting connection element 140*b* of trim assembly 108*b* (e.g., to remove a portion thereof). For instance, securing element 133*a* can be removed, while retaining securing element 133*b* and, optionally retaining one or more adjacent spacing elements 137*a*. Retention member 146*a* can then be coupled with trim assembly 108*d* (by means of securing element 133*b*) or with connection element 140*b* (by means of securing element 133*b*) so as to form trim assembly 108*d*.

Figure 6B:
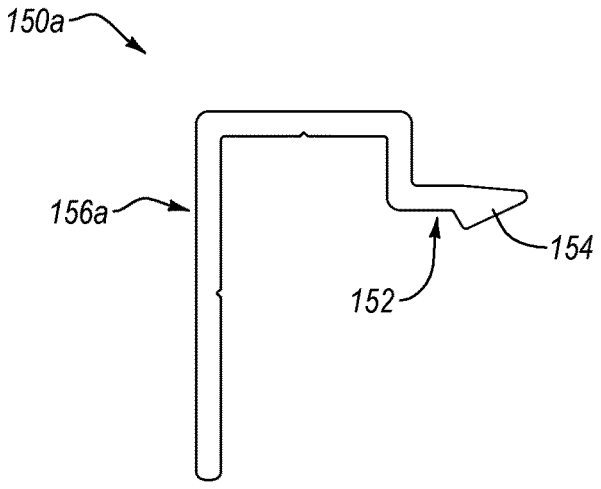
FIG. 6B illustrates a cross-sectional view of a trim assembly component according to another implementation of the present disclosure.

The (truncated) trim assembly 108*d* can be attached by means of an alternative mounting element. For instance, FIG. 6B depicts an alternative mounting element 150*a* having mounting member 152, with retention element 154, and an alternative (wall) joining element 156*a*. Joining element 156*a* can be configured to be attached to (the surface of (an existing) structural component, such as) a wall, such as with a fastener (e.g., adhesive, screw(s), etc.). In particular, joining element 156*a* can be attached to the display surface of existing drywall (adjacent to a ceiling). Trim assembly 108*d* can then be snapped into place onto the existing wall (e.g., by means of mounting member 152 (or retention element 154 thereof)).

It will also be appreciated that the outer profiles of trim assembly 108*d* (or trim elements 130*b* thereof) can be identical, or substantially similar to that of and trim assembly 108*a* (or trim elements 130*a* thereof). In other implementations, however, alternative (non-perpendicular) extension portions and/or (non-curved or -rounded) central portions may also be provided.

FIGS. 7A and 7B illustrate an alternative snap-in trim system 100*a* having an alternative trim assembly 108*c*, comprising a connection element 140*c* and a separate, attachable trim element 130*c*. Connection element 140*c* comprises a first support (arm) 151*a*, having a (separate or attachable) connection member 144*b* (attached thereto) and a second support (arm) 151*b*, having at least one alignment element 142 (protruding therefrom). First support (arm) 151*a* can be disposed at an angle relative to second support (arm) 151*b* and/or extend at an angle therefrom. In at least some embodiments, the angle can be about 45°. In particular, the (45°) angle between first support (arm) 151*a* and second support (arm) 151*b* can accommodate and/or allow for the attachment of trim 130*c* to second support (arm) 151*b* (by means of a receiving element 132 and alignment element 142) so as to form a snap-in (crown molding) trim assembly.

Connection element 140*c* can also comprise a support tab 151*c* (see FIG. 7C) extending (substantially linearly) from second support (arm) 151*b*). Support tab 151*c* can comprise a (partial) cut-out of first support (arm) 151*a* and/or can help ensure proper alignment of trim element 130*c* on the outer face or surface of second support (arm) 151*b*. At least second support (arm) 151*b* can optionally include one or more (e.g., a plurality of) openings 147 extending therethrough. Such openings can permit temperature expansion or contraction, receive a fastener (to couple a trim element to second support (arm) 151*b*, or have another suitable function.

FIG. 7B further depicts a detached (or pre-attached) configuration of snap-in trim system 100*a*. As described above, connection member 144*b* can be configured for reversible attachment to mounting member 152. In particular, trim assembly 108*c* (or trim element 130*c* thereof) can have a first end 136*c* that associates with, contacts, touches, becomes flush with, or is (closely) adjacent to (the surface 114*a* of) wall assembly 112 (or wall panel 114 thereof), at interface 134*b*, and a second end 136*d* that associates with, contacts, touches, becomes flush with, or is (closely) adjacent to (the surface of) ceiling 122, at interface 135*b* (see FIG. 7A). Accordingly, trim assembly 108*a* can provide (tight-fitting, interchangeable, snap-in) trim element(s) that have a standard installation appearance, but without the need for typical or customary trim fasteners (e.g., finishing nails, staples, screws, adhesives, etc.), which may damage the trim or structural element and/or leave holes that require additional time, expense, and effort to fill (e.g., putty) and paint.

As depicted in FIGS. 7C-7D, connection member 144*b* can comprise a unitary piece or configuration having a support body or member 141*b* and a retention member 146*b* (extending therefrom). It will be appreciated, however, that connection member 144*b* can have an attachment mechanism (e.g., with mounting member 152) that is substantially similar and/or universal to other mechanisms described herein. Connection member 144*b* and/or support body or member 141*b* thereof can also have one or more spacing elements 137*b* extending therefrom.

In addition, connection member 144*b* can comprise an attachment area (or slot) 148 and/or one or more support walls 149 (e.g., at least partially defining or bounding attachment area (or slot) 148). First support (arm) 151*a* can be inserted into slot 148 and attached to connection member 144*b*. In at least one implementation, first support (arm) 151*a* can have a notch extending from a front edge thereof to receive a central (or medial) support wall 149 therein. For example, as depicted in FIG. 7E, a first support (arm) 151*d* of a connection element 140*d* can have a notch 153 extending from a front edge 154 of first support (arm) 151*d*. Alternatively, connection member 144*b* and/or slot 148 thereof can be devoid of a central (or medial) support wall 149. Accordingly, a notch may not be necessary or required in all implementations.

First support (arm) 151*d* can be attached to connection member 144*b* by means of one or more fasteners, such as a mechanical coupler or an adhesive. For example, one or more fasteners 106, such as screws, bolts, rivets, clips, etc., can be inserted through (aligned) opening(s) 159 (in connection member 144*b* or support body or member 141*b* thereof) and opening(s) 157 (in connection element 140*b* or first support (arm) 151*d* thereof).

As further depicted in FIG. 7C, at least one alignment element 142 can comprise a plurality of alignment members 142*a*. Alignment member 142*a* can comprise a protrusion extending from the outer surface of second support (arm) 151*b* and sized and configured to (pressure or friction) fit (tightly or snuggly) within receiving element 132 of trim element 130*c* (see FIG. 7A). In some implementations, an adhesive or other fastener can also or alternatively secure trim element 130*c* to connection element 140*c* (or alignment element(s) 142, 142*a* within receiving element 132).

As further depicted in FIG. 7E, trim element 130*d* can be attached to connection element 140*d* at receiving element 132*a*. Trim element 130*d* can have a central portion with an aesthetic shape or design, while maintaining the connection configuration of a first end 136*c* and a second end 136*d*. Thus, trim assembly 108*e* (or trim element 130*d* thereof) can associate with, contact, touch, become flush with, or (closely) adjacent to (the surface of) wall assembly 112 (or wall panel 114, or outer wall surface 14*a* thereof), and/or ceiling 122, as described above.

FIG. 8A illustrates a snap-in trim system 100*c*, comprising a trim corner joint element 170. Joint element 170 can be configured to transition or negotiate between two trim assemblies 108*a*, for example, disposed at a 90° or other angle (inside corner). As depicted in FIG. 8A, joint element 170 can be particularly useful in negotiating a corner having a vertical structure (e.g., pillar) 180 disposed at the corner. Joint element 170 can have a transition surface 171 configured to extend from a first trim element 130*a* to a second trim element 130*a*, disposed orthogonally on to another.

Figure 8B:
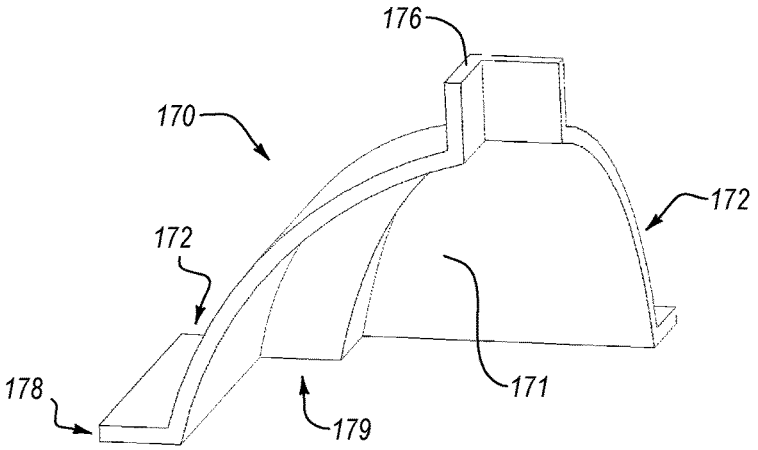
FIG. 8B-8D illustrate various corner joint elements according implementations of the present disclosure.

As depicted in FIG. 8B, joint element 170 can have a trim receiving area 172 opposite transition surface 171. In at least one embodiment, joint element 170 and/or receiving area 172 thereof can be formed at a 90° or other angle suitable for connecting two or more trim elements 130*a* disposed on different (e.g., connected) wall components. Accordingly, connected trim elements 130*a* (e.g., crown molding, baseboard, chair railing, etc.) need not (necessarily) be mitered or cut at an angle (e.g.,) 45° in order to accommodate and/or effectuate the joinder of intersecting trim elements.

Joint element 170 can also have (opposing) wall abutment edge(s) 178 configured to contact the walls connected at the corner. Similarly, joint element 170 can have a ceiling abutment edge 176 configured to contact a ceiling 122 adjacent to the corner. Joint element 170 can further comprise a pillar notch 179 configured to accommodate and/or contact the pillar at the corner. In the assembly configuration depicted in FIG. 8A, corresponding edges of trim assemblies 108*a* can be aligned with wall abutment edge(s) 178 and/or ceiling abutment edge 176. Trim assemblies 108*a* can, therefore, have a square-cut or butt-end (e.g., adjacent to or abutting pillar 180 and/or tucked behind joint element 170) instead of a complex cut end configured to fit or accommodate ceiling 122, pillar 180, and the walls intersecting at the corner.

Figure 8C:
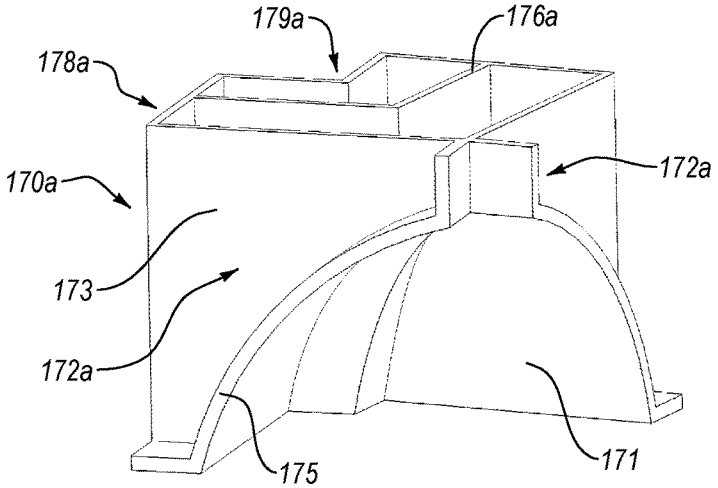

FIG. 8C depicts an alternative joint element 170*a* comprising transition surface 171 and an opposing support structure 173. A lip 175 can extend from transition surface 171 and/or support structure 173. A ceiling abutment edge 176*a* and/or (opposing) wall abutment edge(s) 178*a* can extend from transition surface 171 across support structure 173. A pillar notch 179*a* can also extend from transition surface 171 across support structure 173. Joint element 170*a* can also have opposing receiving areas 172*a* (e.g., disposed on opposing sides of support structure 173). It will be appreciated that corner-situated trim assemblies (or trim elements thereof) can extend behind transition surface 171 so as to be hidden behind lip 175. Support structure 173 can comprise a substantially hollow body with one or more optional support walls extending therethrough. Such a configuration can provide a structurally sound, yet light-weight (polymeric or other) joint element for transitioning between trim elements at a corner.

Figure 8D:
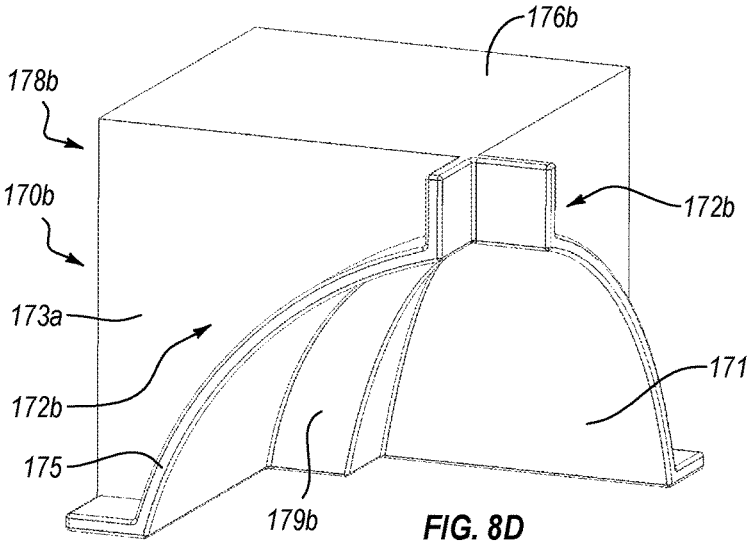

FIG. 8D depicts another alternative joint element 170*b* comprising transition surface 171 and an opposing support structure 173*a*. As depicted, support structure 173*a* can comprise a block having a (smooth or consistent) ceiling abutment edge 176*b* and/or (opposing) wall abutment edge (s) 178*b* extending from transition surface 171 across support structure 173*a*. While joint element 170*b* and/or support structure 173*a* does not include a pillar notch, a pillar protrusion 179*b* can extend from transition surface 171 to provide a universal display between or with other joint elements. Joint element 170*b* can also have opposing receiving areas 172*b* (e.g., disposed on opposing sides of support structure 173*a*). Lip 175 can also extend from transition surface 171 and/or support structure 173*a* such that corner-situated trim assemblies (or trim elements thereof) can extend behind transition surface 171 so as to be hidden behind lip 175.

In other implementations, joint elements can be formed at other than 90° angles to accommodate corners disposed at other than 90°. For instance, in some implementations, joint elements can be formed at 60° or less, between 60° and 90°, between 90° and 120°, or 120° or more. Joint elements can be formed at greater than 180°, such as 270°, between 180° and 270°, or even greater than 270°. Thus, certain joint elements can be configured to negotiate outside corners.

It will be appreciated that at least one implementation of the present disclosure can comprise a wall (crown molding) trim assembly kit, comprising one or more of the components described herein, or a method of installation.

Figure 9:
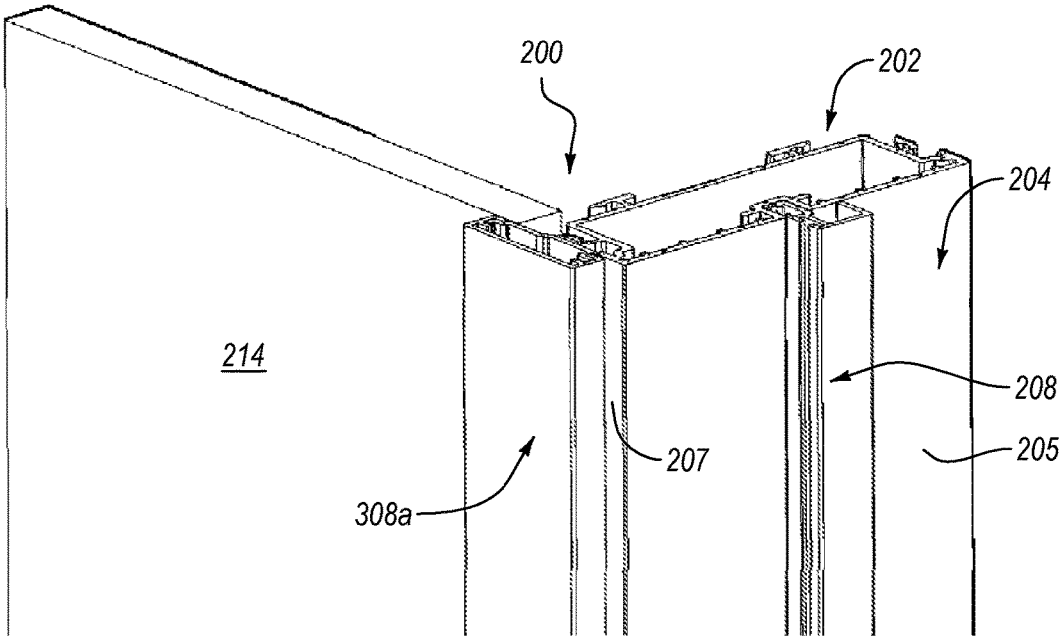
FIG. 9 illustrates a perspective view of a snap-in trim system according to still another implementation of the present disclosure.

FIG. 9 illustrates a snap-in trim system 200 according to another implementation of the present disclosure. Trim system 200 can comprise a doorway (frame) assembly 202, at least one trim element (e.g., a first trim assembly 208 and/or a second trim assembly 308*a*), and/or a wall assembly having a wall element 214. It will be appreciated that other trim systems described herein, such as base board, crown molding, or other trim systems, can be combined with trim system 200 in various forms, combinations, or configurations.

As depicted, doorway assembly 202 includes a (door) jamb element 204. Jamb element 204 can comprise a side jamb, head jamb, floor jamb, etc. Trim assembly 208 can comprise a (door) stop element (e.g., attached substantially in the center of the inner face surface 205 of jamb element 204). Trim assembly 308*a* can comprise a (door) casing element (e.g., attached to a side face surface 207 of jamb element 204 and/or spanning a gap between jamb element 204 and wall element 214).

Figure 10A:
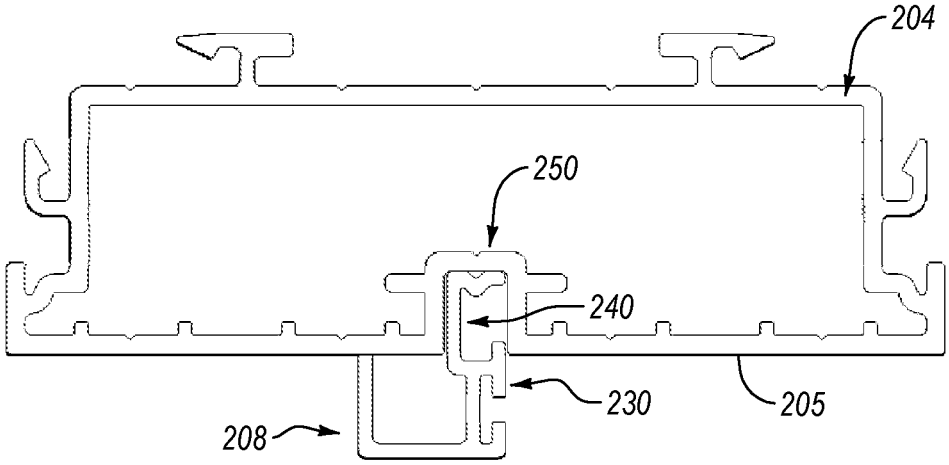
FIGS. 10A-10D illustrate components of the snap-in trim system of FIG. 9 in attached (10A) and detached (10B-10D) configurations.
Figure 10B:
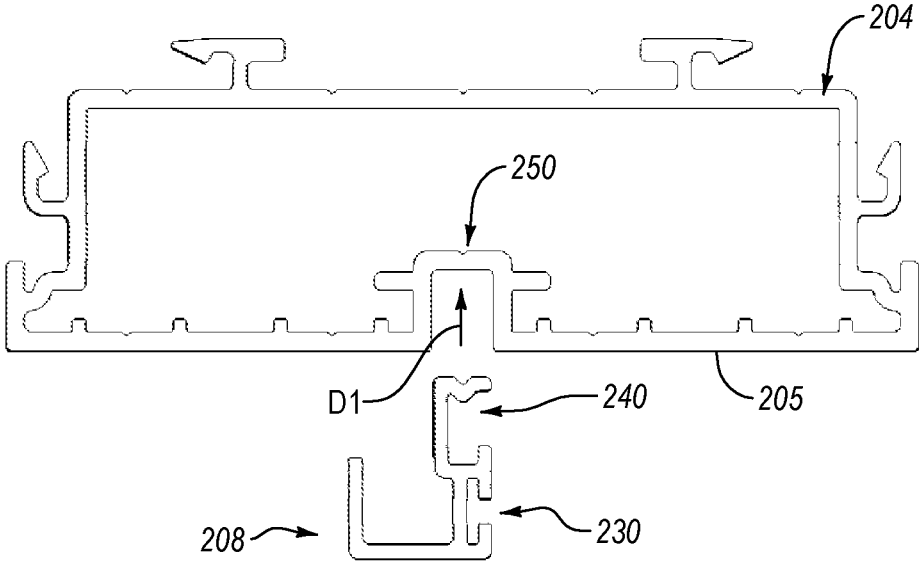
Figure 10C:
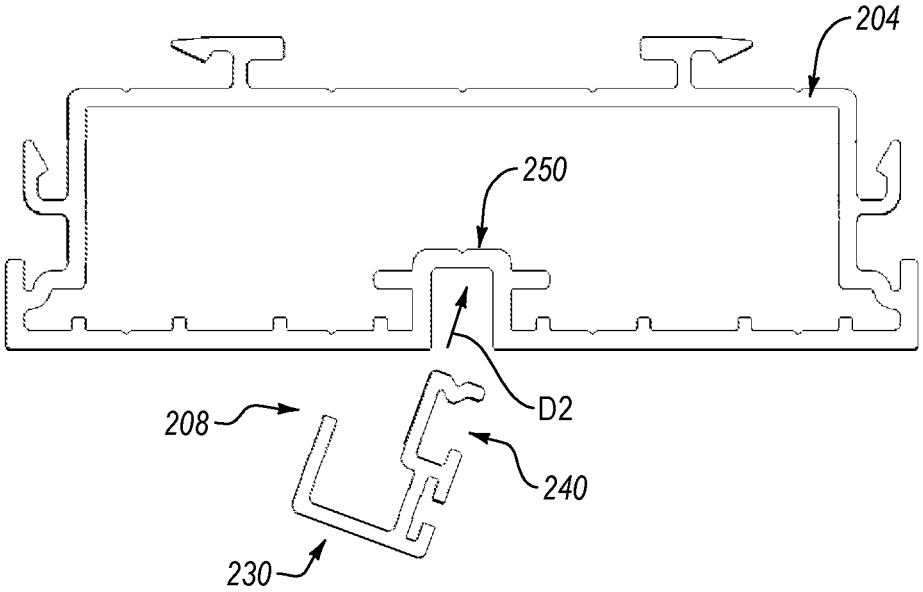
Figure 10D:
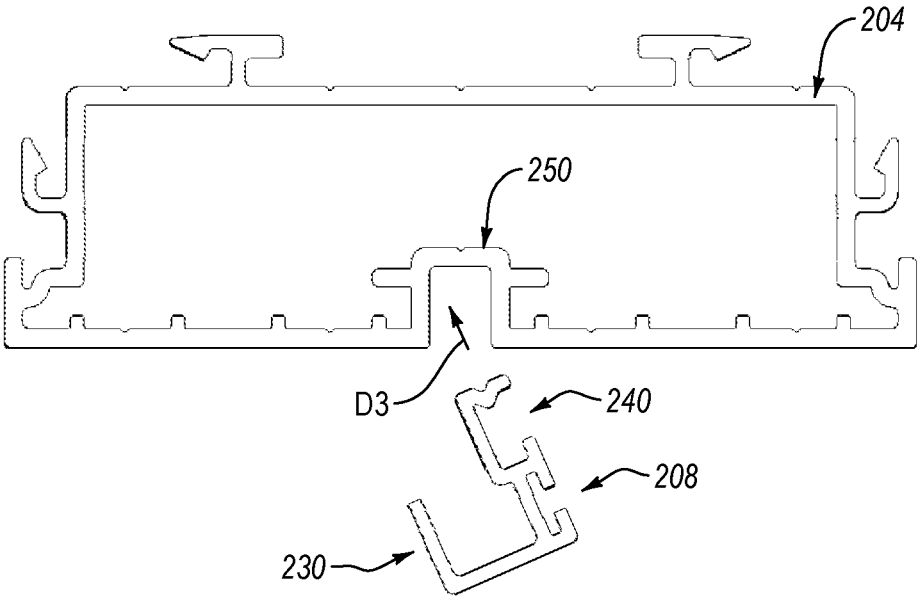

As illustrated in FIGS. 10A and 10B, jamb element 204 can comprise a mounting element 250. Mounting element 250 can comprise a channel extending longitudinally on or along the inner face surface 205 of jamb element 204. Trim assembly 208 can comprise a trim element 230 and a connection element 240 connected thereto, extending therefrom, and or integral therewith. As depicted, connection element 240 can be inserted into (the channel of or formed by) mounting element 250 (e.g., on the inner face surface 205 of jamb element 204) in a substantially anterior-perpendicular direction D1. As depicted in FIGS. 10C and 10D, however, connection element 240 can also or alternatively be inserted into mounting element 250 in a first substantially anterior-lateral-diagonal direction D2 or a second substantially anterior-lateral-diagonal direction D3.

In some implementations, connection element 240 can be pressure, friction, or tension fit into (the channel of or formed by) mounting element 250. Thus, connection element 240 can snap-fit into (the channel of or formed by) mounting element 250 and be reversibly retained therein by the pressure, friction, or tension formed therebetween. In other implementations, at least one fastener (not shown) can extend between mounting element 250 and connection element 240 (to secure connection element 240 to mounting element 250). For instance, in at least one implementation, a screw port (not shown) can be provided in the outer face surface or wall of jamb element 204 (opposite inner face surface 205 and/or behind mounting element 250), such that a screw can be driven from the top (V-groove) of mounting element 250 down into (the corresponding V-groove of) connection element 240.

Figure 11A:
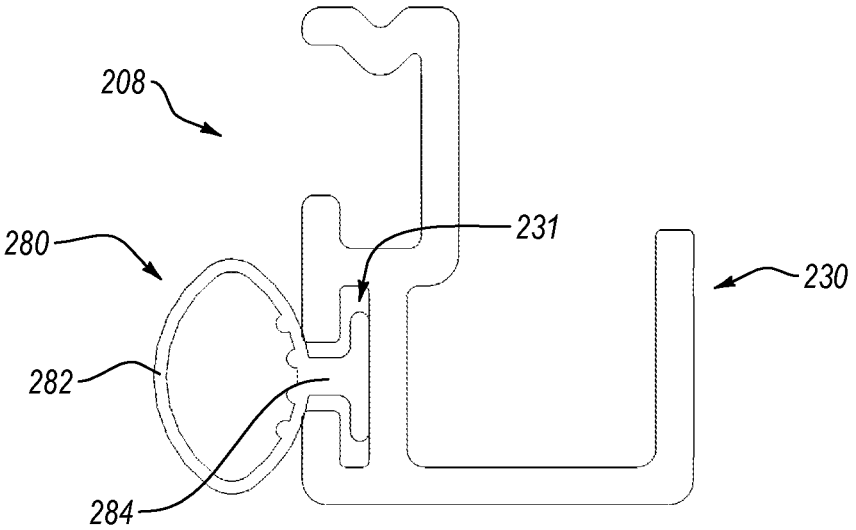
FIGS. 11A-11B illustrate cross-sectional views of trim assembly components according to still another implementation of the present disclosure.

A first side of trim element 230 can have a closed configuration that abuts inner face surface 205 of jamb element 204. As illustrated in FIG. 11A, an opposing second side of trim element 230 can have an attachment member (or channel) 231 formed or disposed therein. In some implementations, attachment member (or channel) 231 can be configured to receive a cushioning, rebounding, or sealing element 280, having an insert member 284 configured to fit (tightly or snuggly) within channel 231, and a rebounding member 282 extending from insert member 284. As depicted, rebounding member 282 can comprise an (elastomeric and/or resiliently flexible) encircling ring or loop. Rebounding element 280 or rebounding member 282 thereof can be configured to cushion or buffer the closing of a door into the door jamb. For instance, a door handle (non-hinge) side of the door can contact rebounding member 282 as it moves into a jamb-closed configuration. Consequently, rebounding member 282 can contract or resiliently flex (inward) to cushion the closing of the door.

Figure 11B:
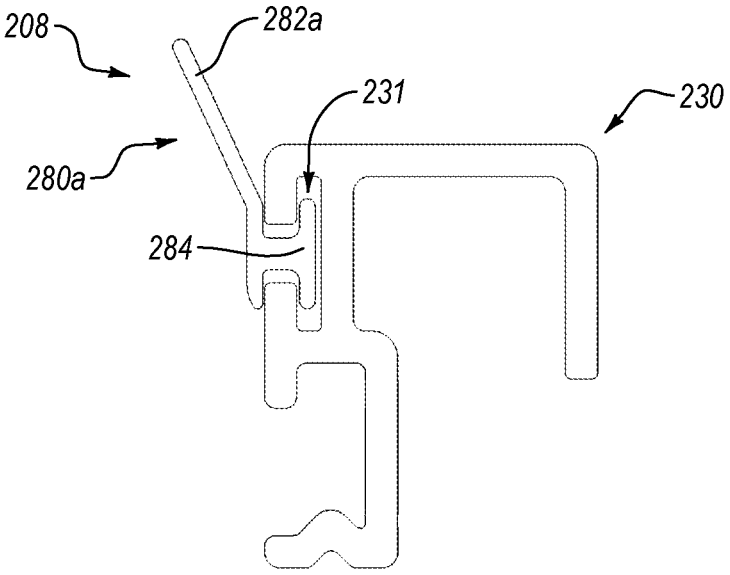

FIG. 11B illustrates an alternative implementation, in which a rebounding element 280*a* comprises insert member 284 and an alternative rebounding member 282*a*. Rebounding member 282*a* comprises an (elastomeric and/or resiliently flexible) arm extending from insert member 284. In at least one implementation, rebounding element 280*a* or rebounding member 282*a* thereof can be configured to cushion or buffer the closing of a door into the doorjamb. For instance, a door hinge (non-handle) side of the door can contact rebounding member 282*a* as it moves into a jamb-closed configuration. Consequently, rebounding member 282*a* can retract or resiliently flex (inward) to cushion the closing of the door.

It will also be appreciated that while attachment member (or channel) 231 is positioned on a first side in FIGS. 10A-10D, trim assembly 208 can also be (vertically) inverted, flipped, turned, rotated, etc., such that attachment member (or channel) 231 is positioned on the opposite side (i.e., faces the opposite direction). Accordingly, a mounted door can be configured to close against attachment member (or channel) 231 (or rebounding member 282, 282*a* attached thereto) from either direction—right or left. Thus, trim assembly 208 can be reversible as a means of modifying a trim system on-demand. Such a (reversible) configuration can be highly advantageous in designing, building, and re-arranging modular wall systems and/or orientations.

Figure 12A:
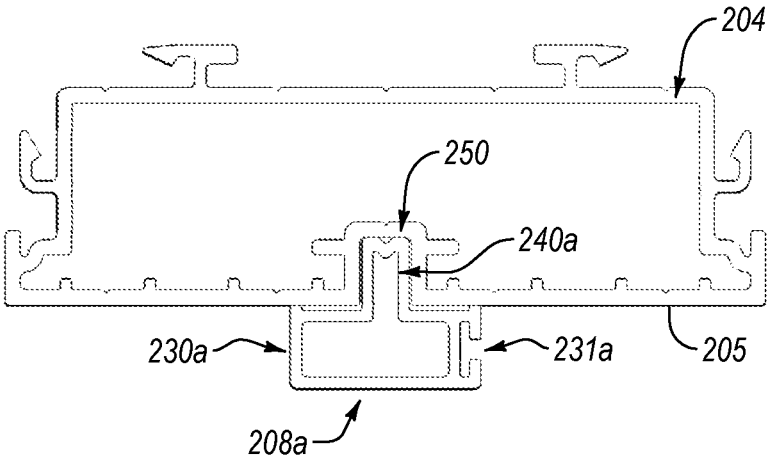

FIG. 12A illustrates an embodiment in which an alternatively configured trim assembly 208*a* is attached to jamb element 204 by means of a connection element 240*a* connected to (or within a channel of) mounting element 250. Connection element 240*a* can have an encircling or closed configuration, as depicted. In addition, a substantially encircling trim element 230*a* can extend from connection element 240*a*, with an optional attachment member (or channel) 231*a* disposed therein. In at least one implementation, trim assembly 208*a* can provide and/or accommodate a wider (commercial or residential) door stop than trim assembly 208. Thus, in some implementations, jamb element 204 can be used universally (for any suitable doorway application or design) by interchanging trim assemblies.

Specifically, the door associated with and/or connected to trim system 200 or doorway assembly 202 thereof can have (an industry standard) residential thickness or commercial thickness, depending on whether trim assembly 208 or 208*a* is used. Moreover, the door can be changed from (an industry standard) residential thickness door to (an industry standard) commercial thickness door, or vice versa, by changing or swapping out trim assembly 208, 208*a* (e.g., without removing (or altering) jamb element 204 (as long as the hinge(s) (e.g., locations, size(s), etc.) remain the same between the two doors).

Figure 13A:
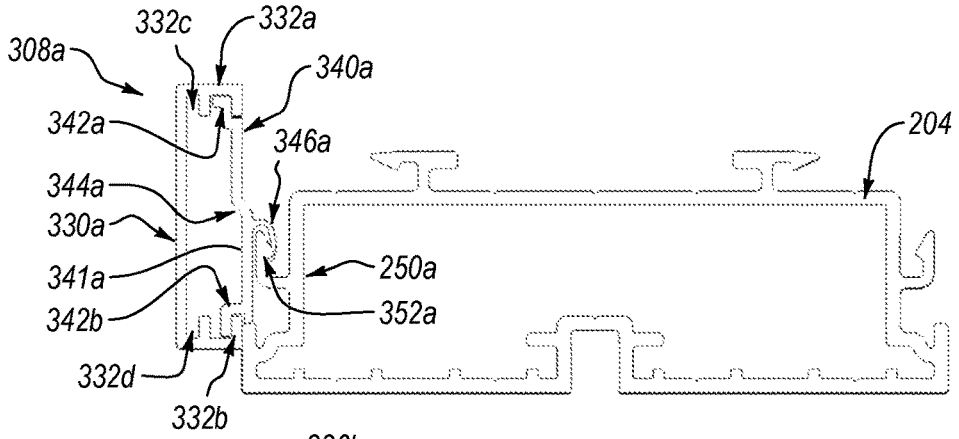
Figure 13B:
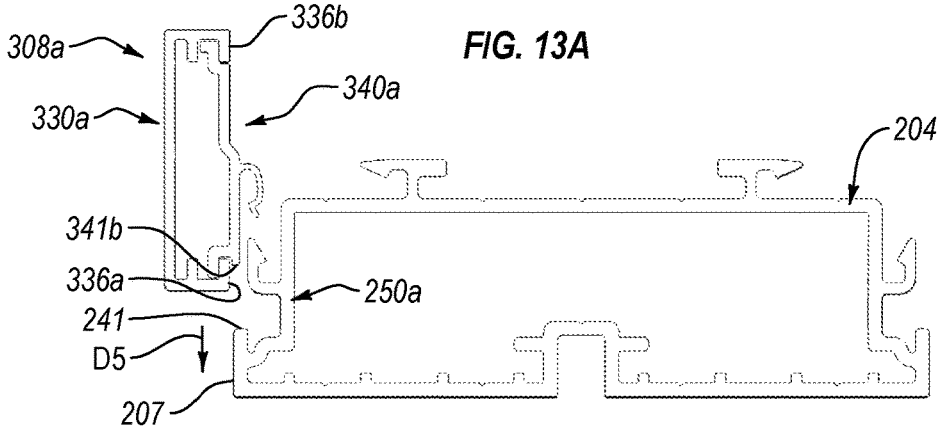
Figure 13C:
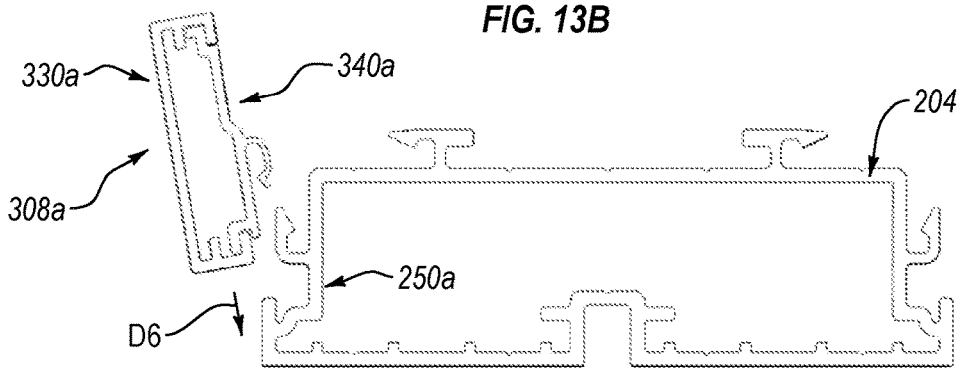

FIGS. 13A, 13B, and 13C illustrate an embodiment in which a trim assembly 308*a* is attached to mounting element 250*a*. Specifically, a connection element 340*a* can be attached to a trim element 330*a* in a manner similar to the attachment mechanisms described above (see e.g., FIGS. 2A and 4, and corresponding description) and connection element 340*a* can be attached to mounting element 250*a* in a manner similar to the attachment mechanisms described above (see e.g., FIGS. 2A-2B, 5B-5C, 7A-7B, and corresponding description). By way of example, trim element 330*a* can comprise a first receiving element 332*a* and opposing second receiving element 332*b*, configured to interface with and/or connect to a first alignment element 342*a* of connection element 340*a* and a second alignment element 342*b* of connection element 340*a*, respectively. Accordingly, trim element 330*a* can be (securely and/or slidably) coupled with connection element 340*a* (e.g., thereby forming trim assembly 308*a*).

In addition, connection element 340*a* can comprise a connection member 344*a*, comprising a support body or member 341*a* and a retention member 346*a* extending therefrom. A mounting member 352*a* of mounting element 250*a* can be inserted between support body or member 341*a* and retention member 346*a*, such that mounting member 352*a* (or a retention element or catch thereof) becomes secured within connection member 344*a*.

Connection element 340*a* can be connected to mounting element 250*a* in a substantially posterior-parallel direction D5, as depicted in FIG. 13B, or in a substantially lateral-posterior-diagonal direction D6, as depicted in FIG. 13C. Accordingly, because trim element 330*a* can be attached to jamb element 204 in an at least partially posterior direction, a (tight and/or gapless) joint or abutment can be achieved between trim element 330*a* and an intersecting trim element and/or (modular) wall component.

In particular, as depicted in FIG. 13B, trim assembly 308*a* (or trim element 330 thereof) can have a first (inner surface) end 336*a* and a second (inner surface) end 336*b*. Trim assembly 308*a* can be configured (e.g., sized and/or shaped, etc.) to attach (e.g., securely snap or lock in place) to mounting element 250*a* such that (i) end 336*a* associates with, contacts, touches, becomes flush with, or is (closely) adjacent to (the side surface 207 of) jamb element 204, and/or (ii) end 336*b* associates with, contacts, touches, becomes flush with, or is (closely) adjacent to (the outer wall (display) surface of) wall element 214 (see FIG. 9). Accordingly, trim assembly 208*a* can provide (tight-fitting, interchangeable, snap-in) trim element(s) that have a standard installation appearance, but without the need for typical or customary trim fasteners (e.g., finishing nails, staples, screws, adhesives, etc.), which may damage the trim or structural element and/or leave holes that require additional time, expense, and effort to fill (e.g., putty) and paint.

In addition, trim assembly 308*a* can be configured such that an interface element 341*b* (of connection element 340*a*) can abut, associate with, contact, touch, becomes flush with, or (closely) adjacent to a corresponding interface component 241 of jamb element 204 (e.g., when trim assembly 308*a*, connection element 340*a*, or connection member 344*a* thereof is attached to jamb element 204 or mounting member 352*a* thereof).

Figure 14:
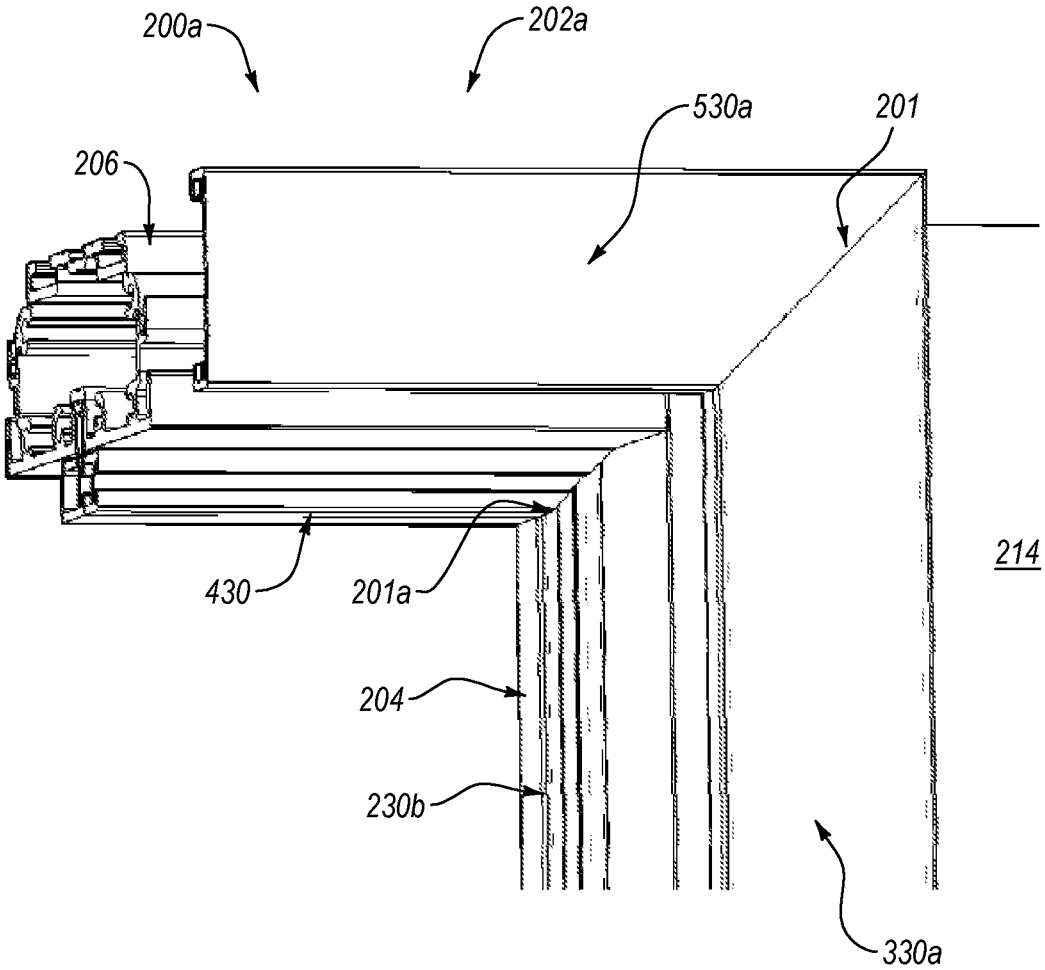

Moreover, as illustrated in FIG. 14, a snap-in trim system 200*a* can include a doorway assembly 202*a* comprising side jamb element 204 and an upper head jamb element 206.

Trim element 330*a* attached to the side face of side jamb element 204 can intersect with an upper trim element 530*a* attached to a side face of head jamb element 206 at an interface 201. As depicted, interface 201 comprises a mitered joint. Interface 201 can be tight and/or gapless in some embodiments (e.g., as one or more of trim elements 330*a* and 530*a* are attached to doorway assembly 202*a* in an at least partially (e.g., substantially) posterior and/or parallel direction).

Figure 14A:
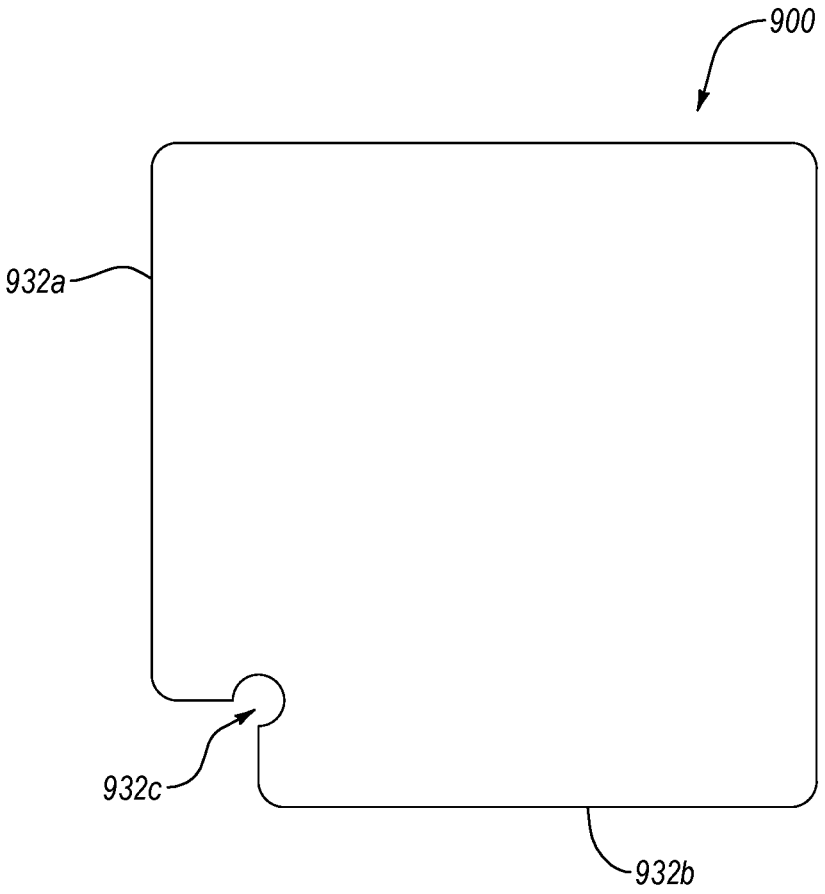

In at least one implementation, additional installation hardware can be provided to align and/or secure intersecting trim elements. For instance, FIG. 14A depicts a trim spline or bracket 900 configured to align and/or secure intersecting trim elements, such as trim elements 330*a* and 530*a*. As depicted in FIG. 13A, for example, trim element 330*a* includes a spline receiving slot (e.g., comprising receiving elements 332*c* and 332*d*). Trim element 530*a* can be similarly configured, such that a first portion 932*a* of trim spline 900 can be disposed, positioned, and/or inserted into receiving element 332*c* of trim element 330*a* and a second portion 932*b* of trim spline 900 can be disposed, positioned, and/or inserted into receiving element 332*d* of trim element 530*a*. A cut-out 932*c* can also be formed in a corner portion of trim spline 900 (e.g., at the intersection between first portion 932*a* and second portion 932*b*). Trim spline 900 can retain and/or maintain trim elements 330*a* and 530*a* at the (miter joint) interface 201 depicted in FIG. 14.

Figure 17:
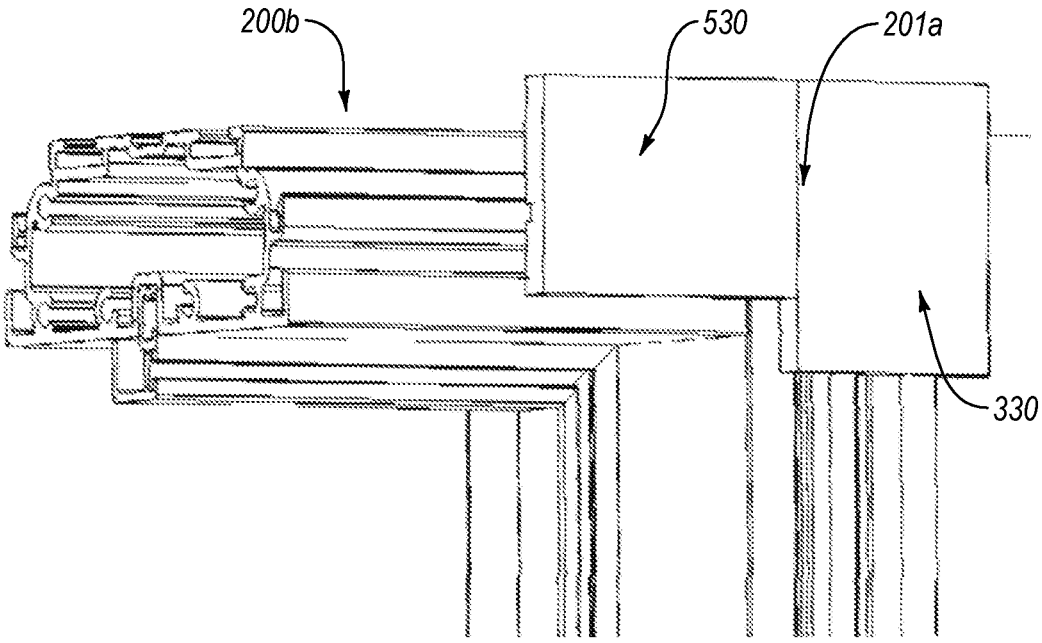

Those skilled in the art will appreciate, however, that interface 201 need not be limited to mitered joints. For instance, certain implementations of the present disclosure can also form and/or accommodate a basic butt joint, a tongue and groove joint, a mortise and tenon joint, a biscuit joint, a pocket joint, a rabbet, a dado, a dovetail, or any other suitable joint for abutment type. As illustrated in FIG. 17, for instance, a trim system 200*b* can include a side trim element 330 intersecting with an upper trim element 530 at an interface 201*a*. Interface 201*a* can comprise a butt joint in some implementations. In addition, implementations of the present disclosure can also provide for and/or accommodate one or more (block and/or joint) adapters, such as a (joint) transition block, plinth block, rosette block, crown block, etc. For instance, in at least one implementation, side trim element 330 can comprise a rosette block. Moreover, at least some implementations, trim element 530 can comprise a lintel detail, capping strip, etc. (e.g., that extends at least partially beyond trim element 330).

Trim elements 330*a* and 530*a* (see FIG. 14) can also be joined at interface 201*a* and/or implemented in trim system 200*b*. Indeed, in certain embodiments and/or throughout the present disclosure, trim elements can be substantially interchangeable.

Returning to FIG. 14, trim system 200*a* can include an inner side jamb trim element 230*b* attached to the anterior face of side jamb element 204 and an inner head jamb trim element 430 attached to the anterior face of upper jamb element 206. Side trim element 230*b* can intersect with an upper trim element 430 at an interface 201*a* (e.g., comprising a miter joint).

Figure 15A:
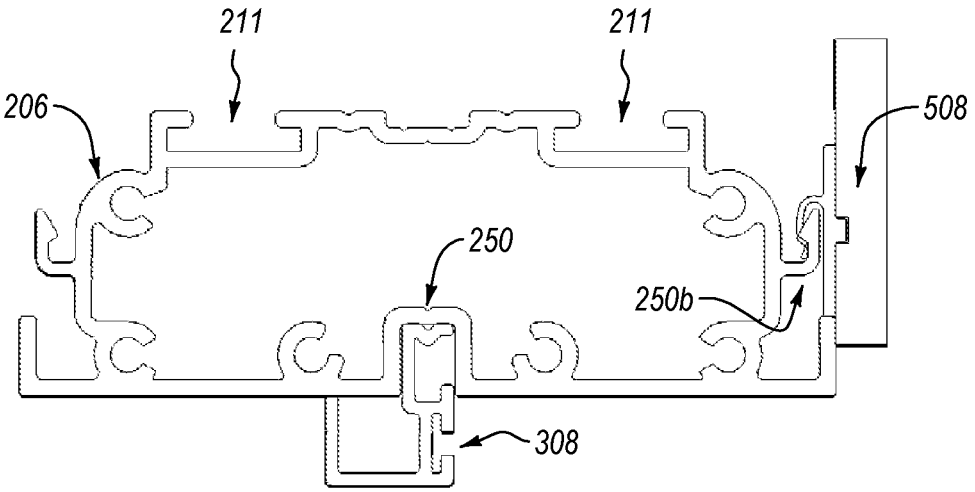
Figure 15B:
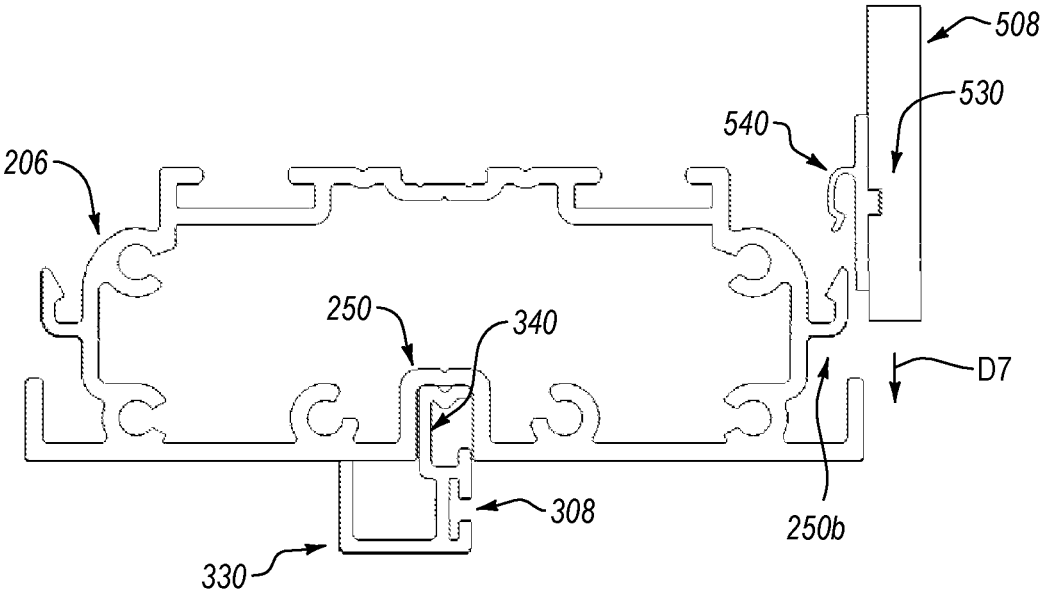

FIG. 15A illustrates a cross-sectional view of head jamb element 206 having trim assemblies 308 and 508 connected thereto. In particular, FIG. 15B depicts the attachment of a trim assembly 508 (comprising trim element 530 and connection element 540) to head jamb element 206 (or mounting element 250*b* thereof) in a substantially posterior-parallel direction D7. FIG. 15B also depicts the attachment of trim assembly 308 (comprising trim element 330 and connection element 340) to mounting element 250 of head jamb element 206.

FIG. 15A further illustrates header attachment component (s) 211 (e.g., provided on the outer face surface or wall of head jamb element 206 (opposite and/or behind mounting element 250)). Header attachment component(s) 211 can be configured to receive (an X-shaped or other) connection interface component (e.g., to couple and/or secure head jamb element 206 to a structural (wall frame) component, as further described in WO 2015/126762, filed 13 Feb. 2015, the entire content of which is incorporated herein by specific reference).

Figure 16:
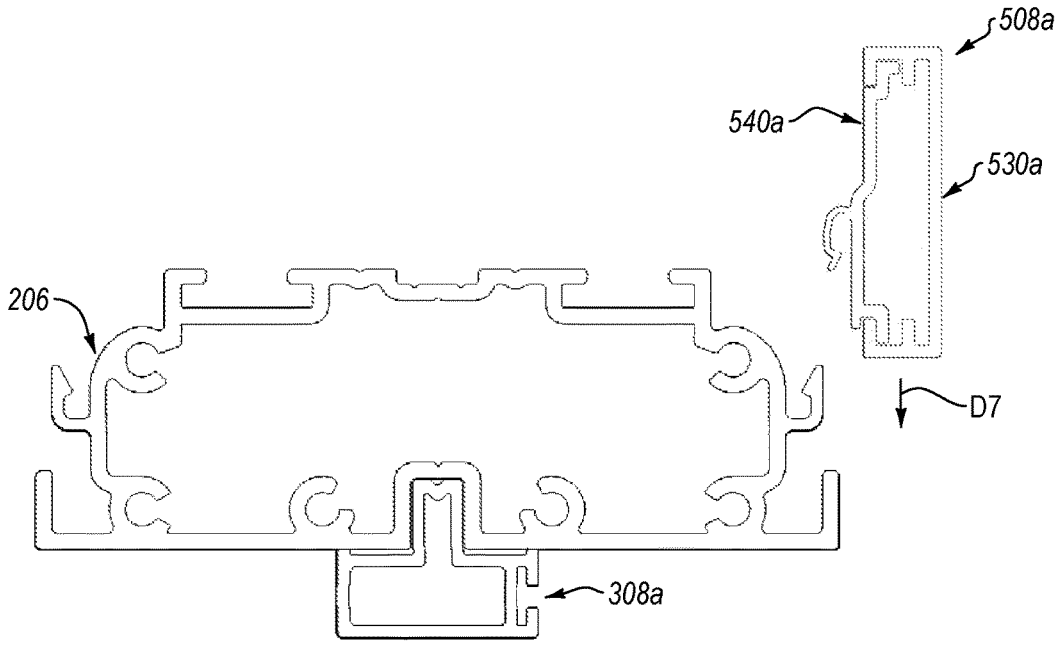

As depicted in FIG. 16, alternative trim assembly 308*a* and alternative trim assembly 508*a* (comprising trim element 530*a* and connection element 540*a*) can also be attached to head jamb elements 206.

Figure 18:
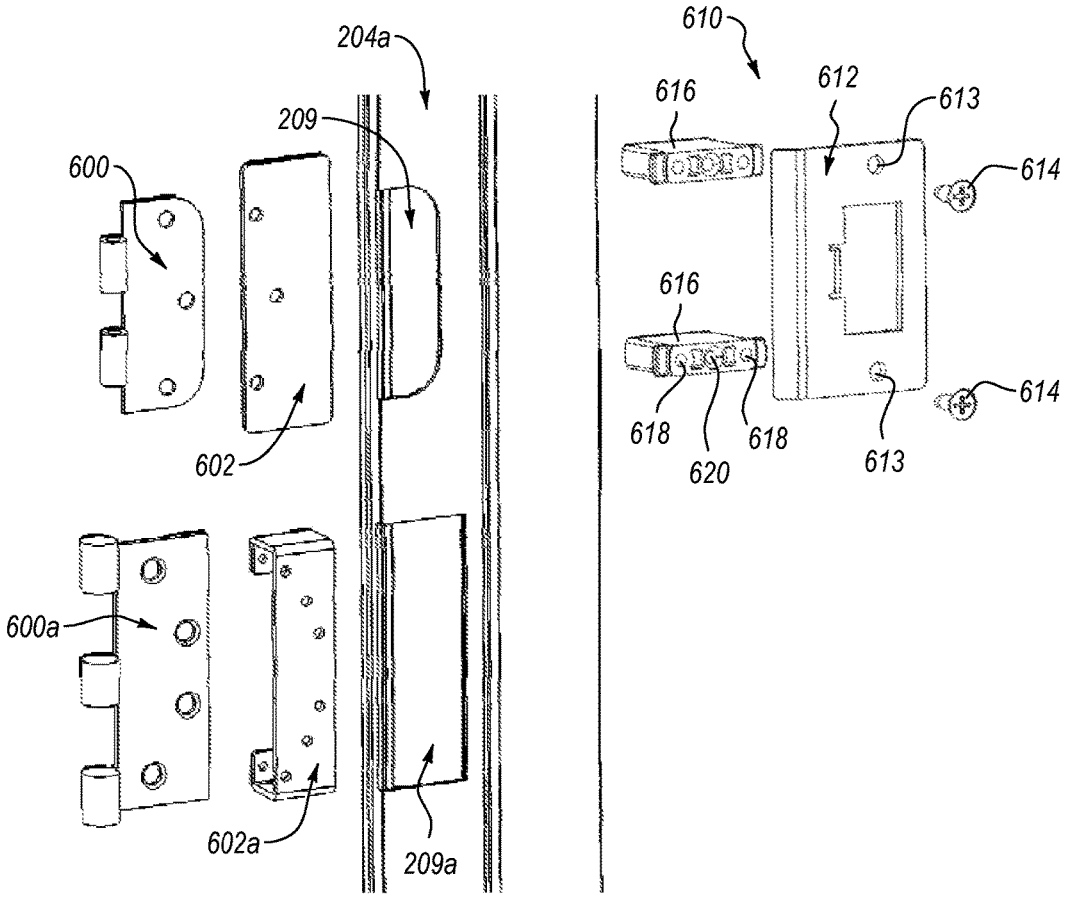
FIGS. 18-19 illustrate various components of a snap-in trim system according to still another implementation of the present disclosure.

Those skilled in the art will appreciate that a doorjamb assembly may also include additional features and/or hardware. For instance, as illustrated in FIG. 18, a side jamb element 204*a* can include one or more hardware attachment elements 209, 209*a*. The hardware attachment element(s) 209, 209*a* can receive a hinge element mounting bracket 602, 602*a*, which can be coupled with a corresponding hinge element 600, 600*a*. In addition, side jamb element 204*a* can receive one or more door strike assemblies 610, comprising a door strike component 612 and one or more door strike mounting components 616.

Similar to other features described herein, door strike component 612 can be attached to door strike mounting components 616 by means of one or more fasteners 614 (e.g., extending through corresponding and/or aligned openings 613 and 620 of door strike component 612 and door strike mounting components 616, respectively). In addition, door strike mounting components 616 can be attached to side jamb element 204*a* (or an underlying door or wall frame element) by means of one or more fasteners 614 (e.g., extending through openings 618 of door strike component 612 and into side jamb element 204*a* (or the underlying door or wall frame element).

Figure 19:
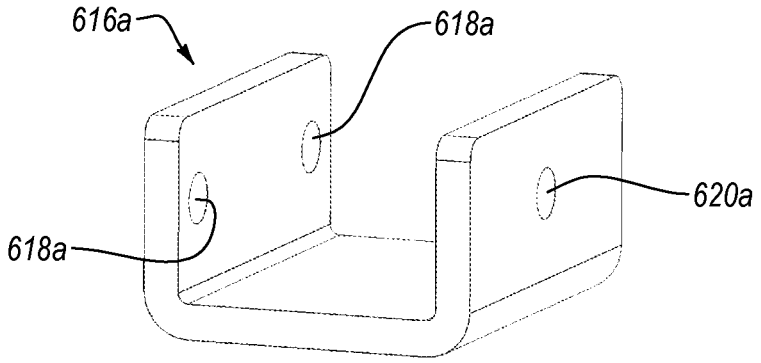

FIG. 19 illustrates an alternative door strike mounting component (or bracket) 616*a*, having a substantially (squared) U-shaped configuration, with one or more jamb element (or underlying door or wall frame element) attachment openings 618*a* and one or more door strike component attachment openings 620*a*.

It will be appreciated that at least one implementation of the present disclosure can comprise a door trim assembly kit, comprising one or more of the components described herein, or a method of installation.

Figure 20A:
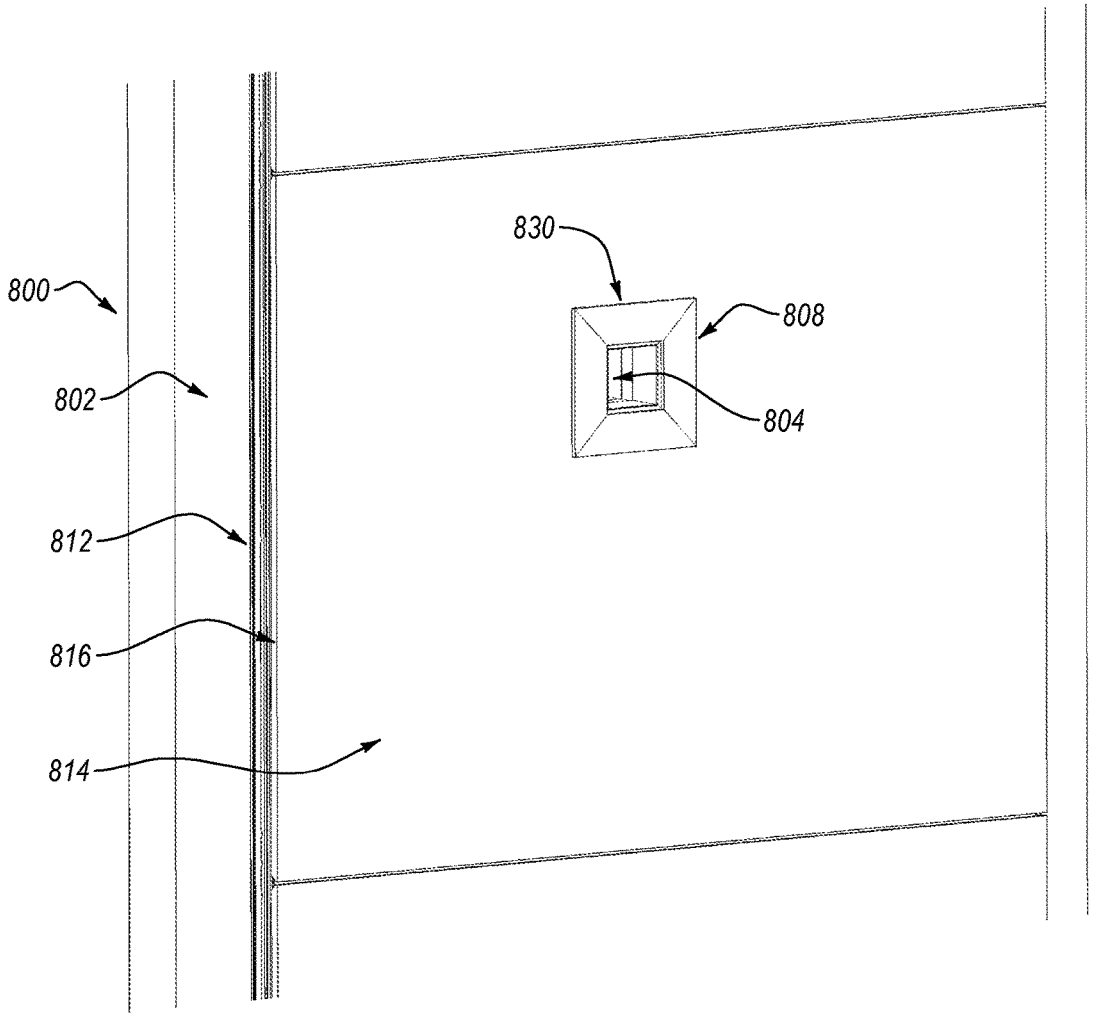
FIGS. 20A-20C illustrate various components of a snap-in trim system according to still another implementation of the present disclosure.
Figure 20B:
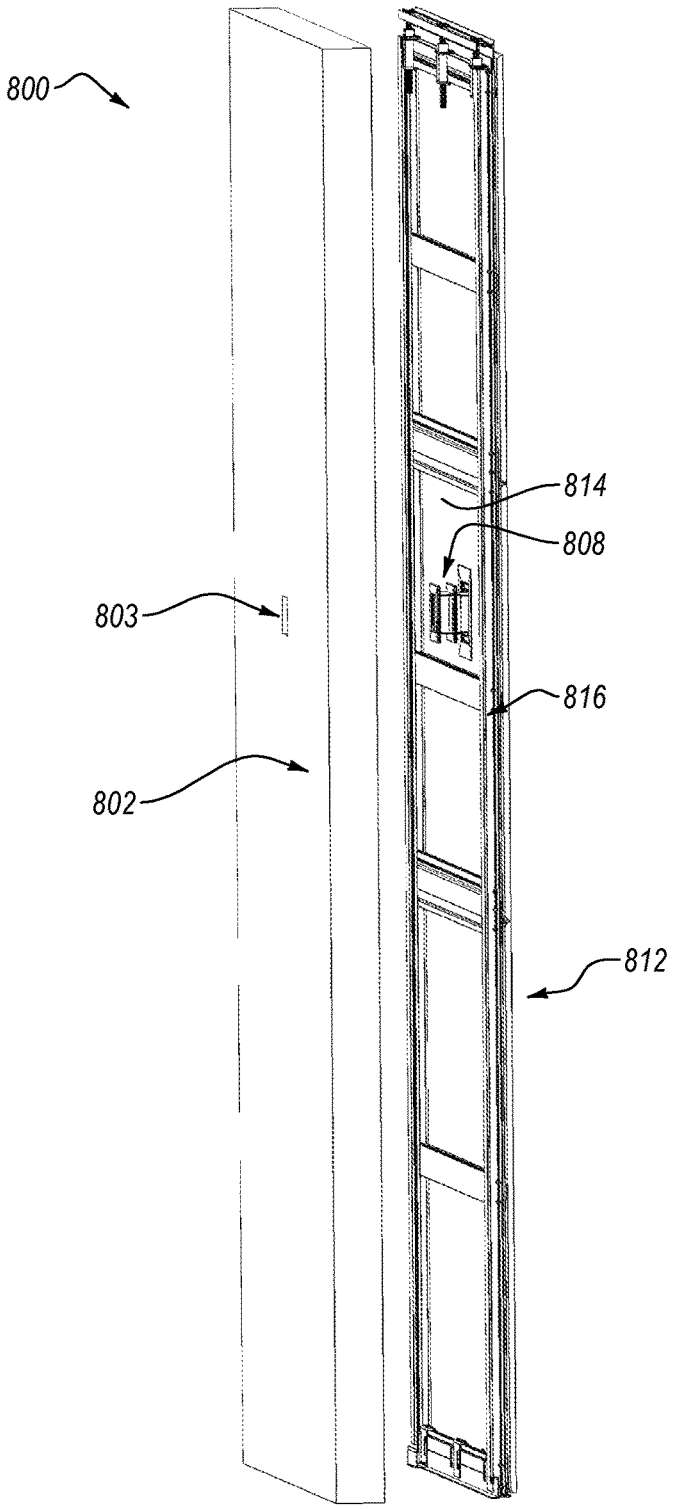
Figure 20C:
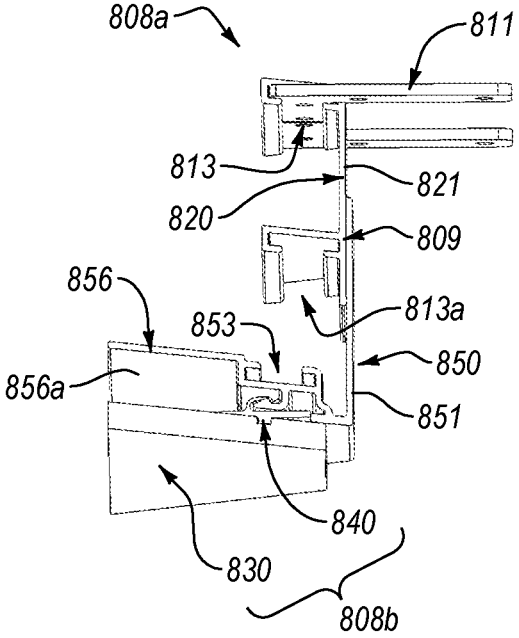

FIGS. 20A-20C illustrate an alternative snap-fit trim system 800 configured to provide snap-fit window casing. As depicted in FIGS. 20A and 20B, a (permanent) wall 802, such as an exterior and/or structural building wall, can have a window 803 extending therethrough. Trim system 800 can include a (modular or movable) wall assembly 812, comprising a frame element 816 and a wall panel 814 attached thereto, as described previously. Modular wall assembly 812 (or frame element 816 and wall panel 814 thereof) can also have a cut-out (or window) 804 extending therethrough and/or aligned with window 803. It is noted that while window 803 is depicted as a small aperture or opening through wall 802, trim system 800 can be adapted (or adaptable) for any suitable window size in commercial, residential, industrial, or other building space. Moreover, trim system 800 can be adapted (or adaptable) for non-square and/or non-rectangular windows.

Trim system 800 can also include a trim assembly 808. Trim assembly 808 can include four connected trim sub-assemblies 808*a*. As further depicted in FIG. 20C, trim sub-assembly 808*a* can (each) comprise a trim element 830. The trim elements 830 of the four sub-assemblies 808*a* form an encircling frame or casing around window 804. A connection element 840 can be attached to each trim element 830 as described previously. Similarly, connection element 840 can be coupled with a mounting element 850 as described previously.

Mounting element 850 can be further coupled with modular wall assembly 812 (or frame element 816 and/or wall panel 814 thereof). For instance, mounting element 850 can comprise a joining element 856, having a joining surface 856*a*, which can be fastened to modular wall assembly 812 (or frame element 816 and/or wall panel 814 thereof), such as with one or more fasteners (e.g., adhesive, screws, etc.), and such that wall panel 814 is disposed between joining element 856 (or joining surface 856*a* thereof) and trim element 830. Alternatively, a portion of wall panel 214 can be captured, such as by tension- or pressure-fit between joining element 856 (or joining surface 856*a* thereof) and an attached trim assembly 808*b* (or trim element 830 thereof), as described in further detail below.

Trim sub-assemblies 808*a* can also include a coupling element 820 connected or connectable to mounting element 850 at an interface 809, such as with one or more fasteners (e.g., adhesive, screws, etc.) or with a friction fit (e.g., with the four mounting elements 850 fitting inside the four coupling elements 820). It is also noted that interface 809 can be slidable, variable, and/or telescopic in nature. In particular, a portion of mounting element 850 can slide along a portion of coupling elements 820 to accommodate a variety of suitable distances (and even non-parallel angles) between (permanent) wall 802 and (modular and/or movable) wall assembly 812.

In at least one implementation, coupling element 820 can also be attached to modular wall assembly 812 (or frame element 816 and/or wall panel 814 thereof), such as with one or more fasteners (e.g., adhesive, screws, etc.). Moreover, coupling element 820 can be attached to wall 802 (e.g., adjacent to window 803 thereof), such as with one or more fasteners (e.g., adhesive, screws, etc.). Coupling element 820 can also include a slot 813, into which an assembly bracket (such as a square-angle bracket) 811 can be inserted. Adjacent slots 813 of adjacent coupling elements 820 can receive opposing sides of the same assembly bracket 811. Mounting element 850 can also include a slot 853 for receiving a spline or bracket. An additional slot 813*a* (of coupling element 820) can be provided between slot 813 and slot 853 of mounting element 850.

With continued reference to FIG. 20C, it will be appreciated that in the assembled and/or installed configuration (see e.g., FIG. 20A) inner surface 851 of mounting element 850 can be seen, visible, and/or exposed in the interior of cut-out (or window) 804. In some implementations, mounting element 850 can cover at least a portion of inner surface 821 of coupling element 820, such that inner surface 821 is not seen, visible, and/or exposed in the interior of cut-out (or window) 804. In other implementations, however, at least a portion of inner surface 821 can also be seen, visible, and/or exposed in the interior of cut-out (or window) 804. Other components, such as joining element 856, slots 813, 813*a*, 853, etc., however, can be hidden by or behind inner surface(s) 821 and/or 851.

It will be appreciated that at least one implementation of the present disclosure can comprise a modular window trim assembly kit, comprising one or more of the components described herein, or a method of installation.

An illustrative method of installing or assembling trim system 800 can include, for example, assembling a plurality of coupling elements 820 into a coupling element assembly. As depicted, the coupling element assembly can comprise four coupling elements 820, assembled into a square (or rectangular) configuration. It will be appreciated, however, that other, non-square or -rectangle configurations are contemplated herein. The coupling element assembly can also include one or more assembly brackets 811 disposed in or extending between adjacent slot(s) 813 of adjacent coupling elements 820. Accordingly, the method can include inserting (opposing arms of four) assembly brackets 811 into respective slots 813 of (four) coupling elements 820. At least one implementation can include securing assembly bracket(s) 811 within slot(s) 813.

The method can include mounting the coupling element assembly (e.g., assembled and/or coupled assembly brackets 811 and coupling elements 820) to a face (or surface) of wall 802 (e.g., such that the coupling element assembly assembled encircle window 803). The coupling element assembly can be mounted to wall 802 with any suitable fastener, such as an adhesive (e.g., glues or VHB tape, as known in the art) or hardware.

The method can include providing (e.g., cutting) cut-out (or window) 804 in wall panel 814. The method can also include assembling a plurality of (e.g., four) mounting elements 850 into a mounting element assembly. The mounting element assembly can also include one or more assembly brackets disposed in or extending between adjacent slot(s) 853 of adjacent mounting elements 850. Accordingly, the method can include inserting (opposing arms of four) assembly brackets 811 into respective slots 853 of (four) coupling elements 820. At least one implementation can include securing assembly bracket(s) 811 within slot(s) 853.

The method can also include attaching the mounting element assembly (of mounting elements 850) or joining elements 856 thereof to a modular wall assembly 812 (or frame element 816 and/or wall panel 814 thereof). For instance, joining surface 856*a* can be attached (e.g., adhered) to an inner (non-display) surface of wall panel 814 (e.g., opposite the outer wall surface thereof). In particular, joining surface 856*a* can be attached to wall panel 814 so as to substantially encircle cut-out (or window) 804 on the inner (non-display) surface of wall panel 814 (e.g., opposite the outer wall surface thereof). Alternatively, mounting elements 850 can be attached individually and/or independently to wall panel 814 (e.g., without first assembling the mounting element assembly).

The method can include positioning the attached mounting element assembly-modular wall such that cut-out (or window) 804 (with the mounting element assembly disposed thereabout) is substantially aligned with window 803 of wall 802 (with the coupling element assembly disposed thereabout). The method can include coupling the attached mounting element assembly-modular wall (or mounting element(s) 850 thereof) with the attached coupling element assembly-structural wall (or coupling element(s) 820 thereof). In at least one implementation, coupling can include inserting extension(s) or inner surface(s) 851 of mounting element(s) 850 inside extension(s) or inner surface (s) 821 of coupling element(s) 820. For example, the modular wall-mounting element assembly can be telescopically positioned relative to the structural wall-coupling element assembly to achieve a desired distance therebetween.

In certain implementations, while the mounting element assembly can be secured (e.g., affixed) to the modular wall, and the coupling element assembly can be secured to the structural wall, mounting element(s) 850 need not be secured to coupling element(s) 820. For instance, once a desired distance is achieved, the modular wall frame (elements) can be mounted to the floor/sub-floor and ceiling of the building structure without (independently) affixing mounting element(s) 850 to coupling element(s) 820. It will also be appreciated that the structural wall can be secured to the building foundation.

The method can also include assembling (e.g., four) trim assemblies 808*b*, comprising and/or by attaching trim element(s) 830 to respective connection element(s) 840. Each trim assembly 808*b* can then be snap-fit into place by connecting each connection element 840 to a corresponding mounting element 850, as described previously (e.g., in a miter joint fit, as depicted in FIG. 20A, or other configuration). In an alternative implementation, joining element 856 (or joining surface 856*a* thereof) need not be adhered to a portion of wall panel 214. Rather, a portion of wall panel 214 can be captured, such as by tension- or pressure-fit between joining element 856 (or joining surface 856*a* thereof) and an attached trim assembly 808*b* (or trim element 830 thereof), as described above.

It will also be appreciated that implementations of the present disclosure can provide a wide variety of (modular) wall systems that provide a wide variety of benefits. For example, implementations of the present disclosure can provide a snap-in trim system. The trim system can accommodate on demand configuration and/or reconfiguration of (modular) wall trim elements, including industry-standard and/or off-the-shelf trim elements. Trim systems can include a trim assembly, comprising a trim element attached and/or attachable to a connection element. The trim assembly or connection element thereof can in turn be attached and/or attachable to a mounting element. The mounting element can in turn be attached and/or attachable to a structural component of a building, such as a wall and/or modular wall assembly. In at least one implementation, the trim system can extend between a permanent structural wall of a building and a modular wall assembly.

In addition, it will be appreciated that a variety of components described herein can have elongated, longitudinally extending configurations. Such configurations can result from manufacturing and/or fabrication processes, such as cutting of wood components. Such configurations can also result from extrusion processing, such as injection molding, die-casting, or other manufacturing, fabricating, or forming of polymeric (plastic) material(s). Elongated materials can be attachable one to another, such as by snap-fitting and/or fastener(s). In other implementations, attachment mechanisms can be slidable, with a longitudinal channel formed in one components and a longitudinal insert formed in a connectable component.

Various alterations and/or modifications of the inventive features illustrated herein, and additional applications of the principles illustrated herein, which would occur to one skilled in the relevant art and having possession of this disclosure, can be made to the illustrated implementations without departing from the spirit and scope of the invention as defined by the claims, and are to be considered within the scope of this disclosure. Thus, while various aspects and implementations have been disclosed herein, other aspects and implementations are contemplated. While a number of methods and components similar or equivalent to those described herein can be used to practice implementations of the present disclosure, only certain components and methods are described herein.

It will also be appreciated that systems, processes, and/or products according to certain implementations of the present disclosure may include, incorporate, or otherwise comprise properties or features (e.g., components, members, elements, parts, and/or portions) described in other implementations disclosed and/or described herein. For instance, various features (e.g., cushioning or buffering element 139, bracket 811, etc.) described herein in relation to one implementation can be (interchangeably) substituted in other implementations of the present disclosure. Accordingly, the various features of certain implementations can be compatible with, combined with, included in, and/or incorporated into other implementations of the present disclosure. Thus, disclosure of certain features relative to a specific implementation of the present disclosure should not be construed as limiting application or inclusion of said features to the specific implementation. Rather, it will be appreciated that other implementations can also include said features without necessarily departing from the scope of the present disclosure.

Moreover, unless a feature is described as requiring another feature in combination therewith, any feature herein may be combined with any other feature of a same or different implementation disclosed herein. Furthermore, various well-known aspects of illustrative systems, processes, products, and the like are not described herein in particular detail in order to avoid obscuring aspects of the example implementations. Such aspects are, however, also contemplated herein.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain implementations and details have been included herein and in the attached disclosure for purposes of illustrating implementations of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

We claim:

1. A slidable snap-in trim system for securing a trim element to a structural component of a building, the system comprising:

a mounting element securable to or integrated with a structural component of a building, the mounting element extending longitudinally along a length of the structural component; and a trim assembly securely coupleable to the mounting element, wherein the trim assembly comprises:

a connection element securely coupleable to the mounting element; and a trim element attached or attachable to the connection element;

wherein:

(i) the mounting element comprises a protrusion having a retention element disposed thereon; and (ii) the connection element comprises a support member, and a resiliently flexible retention member configured to receive the retention element so as to inhibit or substantially prevent inadvertent detachment of the connection element from the mounting element.

2. The trim system of claim 1, wherein the connection element is securely coupleable to the mounting element such that the connection element can slide longitudinally along the length of the structural component while remaining securely coupled to the mounting element.

3. The trim system of claim 1, wherein the structural component comprises:

a modular wall assembly comprising a frame element and at least one wall panel attached to the frame element; and/or a structural building wall assembly at least partially built of conventional construction materials and techniques.

4. The trim system of claim 1, wherein the mounting element comprises a modular wall base element and the trim assembly comprises an attachable base board.

5. The trim system of claim 1, wherein the mounting element comprises a modular wall header element and the trim assembly comprises an attachable crown molding.

6. The trim system of claim 1, wherein the mounting element comprises a door frame element and the trim assembly comprises an attachable door stop.

7. The trim system of claim 6, further comprising a cushioning element attachable to the trim element and configured to cushion a closing door.

8. The trim system of claim 1, wherein the mounting element comprises a door frame element and the trim assembly comprises an attachable door casing.

9. The trim system of claim 1, wherein the mounting element comprises a window frame element and the trim assembly comprises an attachable window casing.

10. The trim system of claim 1, wherein the mounting element comprises a channel and the connection element comprises an insert securable within the channel.

11. The trim system of claim 1, wherein the connection element is anteriorly-laterally attachable to the mounting element.

12. The trim system of claim 1, wherein the connection element is lateral-posterior-diagonally attachable to the mounting element.

13. The trim system of claim 1, wherein the trim element comprises a receiving element and the connection element comprises an alignment element attachable to the receiving element.

14. The trim system of claim 13, wherein the trim element is longitudinally-slidably attachable to the connection element.

15. The trim system of claim 13, wherein the trim element is anteriorly-laterally attachable to the connection element.

16. The trim system of claim 1, wherein the trim element is integrally formed with the connection element.

17. A slidable snap-in trim system for securing a trim element to a structural component of a building, the system comprising:

a structural component comprising a modular wall element;

a mounting element secured to or integrated with the structural component, the mounting element extending longitudinally along a length of the structural component;

a connection element securely coupled to the mounting element such that the connection element is slidable along the length of the structural component while remaining securely coupled to the mounting element; and a trim element attached to or integrated with the element component;

wherein:

(i) the mounting element comprises a protrusion having a retention element disposed thereon; and (ii) the connection element comprises a support member, and a resiliently flexible retention member configured to receive the retention element so as to inhibit or substantially prevent inadvertent detachment of the connection element from the mounting element.

18. The trim system of claim 17, wherein the connection element is securely coupled to the mounting element such that the connection element is slidable along the length of the structural component while remaining securely coupled to the mounting element.

19. The trim system of claim 17, wherein the mounting element comprises a modular wall base element and the trim assembly comprises an attachable base board.

20. The trim system of claim 17, wherein the mounting element comprises a modular wall header element and the trim assembly comprises an attachable crown molding.

21. The trim system of claim 17, wherein the mounting element comprises a door frame element and the trim assembly comprises an attachable door stop.

22. The trim system of claim 21, further comprising a cushioning element attachable to the trim element and configured to cushion a closing door.

23. The trim system of claim 17, wherein the mounting element comprises a door frame element and the trim assembly comprises an attachable door casing.

24. The trim system of claim 17, wherein the mounting element comprises a window frame element and the trim assembly comprises an attachable window casing.

25. A slidable snap-in trim system for securing a trim element to a structural component of a building, the system comprising:

a mounting element securable to or integrated with a structural component of a building, the mounting element extending longitudinally along a length of the structural component; and a trim assembly securely coupleable to the mounting element, wherein the trim assembly comprises:

a connection element securely coupleable to the mounting element; and a trim element attached or attachable to the connection element;

wherein the trim element comprises a receiving element and the connection element comprises an alignment element attachable to the receiving element.

26. The trim system of claim 25, wherein the trim element is longitudinally-slidably attachable to the connection element.

27. The trim system of claim 25, wherein the trim element is anteriorly-laterally attachable to the connection element.

28. The trim system of claim 25, wherein the connection element is securely coupleable to the mounting element such that the connection element can slide longitudinally along the length of the structural component while remaining securely coupled to the mounting element.

29. The trim system of claim 25, wherein the structural component comprises:

a modular wall assembly comprising a frame element and at least one wall panel attached to the frame element; and/or a structural building wall assembly at least partially built of conventional construction materials and techniques.

30. The trim system of claim 25, wherein the mounting element comprises a modular wall base element and the trim assembly comprises an attachable base board.

31. The trim system of claim 25, wherein the mounting element comprises a modular wall header element and the trim assembly comprises an attachable crown molding.

32. The trim system of claim 25, wherein the mounting element comprises a door frame element and the trim assembly comprises an attachable door stop.

33. The trim system of claim 32, further comprising a cushioning element attachable to the trim element and configured to cushion a closing door.

34. The trim system of claim 25, wherein the mounting element comprises a door frame element and the trim assembly comprises an attachable door casing.

35. The trim system of claim 25, wherein the mounting element comprises a window frame element and the trim assembly comprises an attachable window casing.

36. The trim system of claim 25, wherein the mounting element comprises a channel and the connection element comprises an insert securable within the channel.

* * * * *